United States Patent [19]

Bader et al.

[11] Patent Number: 4,548,021

[45] Date of Patent: Oct. 22, 1985

[54] MULTIPLE CONTAINER PACKAGING SYSTEM

[75] Inventors: James S. Bader, Lakewood; Larry M. Dugan, Boulder, both of Colo.

[73] Assignee: Adolph Coors Company, Golden, Colo.

[21] Appl. No.: 501,008

[22] Filed: Jun. 3, 1983

[51] Int. Cl.[4] ..... B65B 21/24; B65B 61/14

[52] U.S. Cl. ..... 53/398; 53/413; 53/134; 53/48; 53/580; 193/47

[58] Field of Search ..... 53/398, 580, 48, 413, 53/134; 193/47; 198/416

[56] References Cited

U.S. PATENT DOCUMENTS

| | | | |
|---|---|---|---|
| 2,877,614 | 3/1959 | Currivan | 53/48 X |
| 3,094,210 | 6/1963 | Van Den Berg | 53/48 X |
| 3,196,589 | 7/1965 | Cook | 53/48 |
| 3,393,490 | 7/1968 | De Shazor | 53/48 |
| 3,407,563 | 10/1968 | Dieter | 53/398 |
| 3,474,590 | 10/1969 | Ganz | 53/48 X |
| 3,777,450 | 12/1973 | De Shazor | 53/48 X |
| 3,815,320 | 6/1974 | Ganz | 53/48 |
| 4,215,525 | 8/1980 | Nigrew | 53/580 |
| 4,350,466 | 9/1982 | Bahr | 414/128 |

*Primary Examiner*—John Sipos

*Attorney, Agent, or Firm*—Klaas & Law

[57] ABSTRACT

A system for applying clips and covers to cans to form multiple container packages. The system utilizes a prefeed device to obtain a preferential distribution of clips supplied in bulk form. An orienter separates and orients the clips in a manner suitable for application to the cans. The cans are fed in 2 rows and held with a predetermined spacing so that the clips can be applied to form a multiple container package. A cover applicator then applies a cover or coupon to the multiple container package by forcing a prescored portion of the cover into the clip so that it interlocks with the clip. Apparatus is also provided for folding and gluing skirted portions of the cover around the periphery of the multiple container package.

18 Claims, 29 Drawing Figures

MULTIPLE CONTAINER PACKAGING SYSTEM

BACKGROUND OF THE INVENTION

This invention relates generally to a system for forming a multiple container package, and, more particularly to apparatus and methods for applying connecting clips and covers to groups of attached cans to form multiple container packages commonly known as "four packs, six packs, eight packs, etc.".

Retaining clips and covers of the type used by the present invention are disclosed in U.S. Pat. No. 4,216,859 of James S. Bader et al., for Can Clip And Packages; and U.S. patent application Ser. No. 292,811 of James S. Bader filed Aug. 14, 1981 now U.S. Pat. No. 4,423,810, for Cover For Multiple Unit Container Packages, the disclosures of which are hereby specifically incorporated herein by reference.

SUMMARY OF THE INVENTION

In general, the present invention comprises apparatus for applying clips to groups of unattached containers to form multiple container packages of at least four containers held in substantially parallel closely spaced arrangement by mounting the clips in a central gap formed between the groups of unattached containers and engaging rim portions of the unattached containers to form the multiple container packages comprising: container infeed conveyor means for laterally moving a plurality of parallel rows of the unattached containers in a closely spaced, generally abutting relationship; container separating means associated with the container infeed conveyor means for longitudinally and transversely separating the unattached containers by a predetermined distance so as to define central gaps suitable for mounting the clips; clip orienting means for separating and aligning the clips in proper predetermined orientation suitable for placement in the central gaps and connection to rim portions of the unattached containers; clip applicator means for receiving the clip from the clip orienting means and applying the clips to the groups of unattached containers to form the multiple container packages.

The present invention may also include cover applicator means for receiving the multiple container packages from the container package conveyor means and applying a cover member to each of the multiple container packages.

The present invention may also include coupon applicator means for receiving the multiple container packages from the container package conveyor means and applying removable coupons to the multiple container packages.

The present invention may also comprise a method of applying connecting clips to groups of unattached containers to form multiple container packages and applying covers to the multiple container packages comprising: continuously forming a plurality of parallel rows of the unattached containers; conveying the plurality of parallel rows of the unattached containers to a clip applicator; separating the unattached containers by a predetermined distance to define central gaps between adjacent unattached containers suitable for applying the connecting clips; positioning the connecting clips for application to the central gaps between the adjacent unattached containers using a clip applicator wheel; applying the connecting clips to the groups of unattached containers by forcing the clips into the central gaps using a cam actuated clip applicator; placing covers in proximate relationship with the multiple container packages; attaching the covers to the multiple container packages; gluing and folding flap portions of the covers around the multiple container packages.

BRIEF DESCRIPTION OF THE DRAWINGS

A presently preferred and illustrative embodiment of the invention is shown in the accompanying drawing wherein.

DETAILED DESCRIPTION OF THE INVENTION

Figure 1:
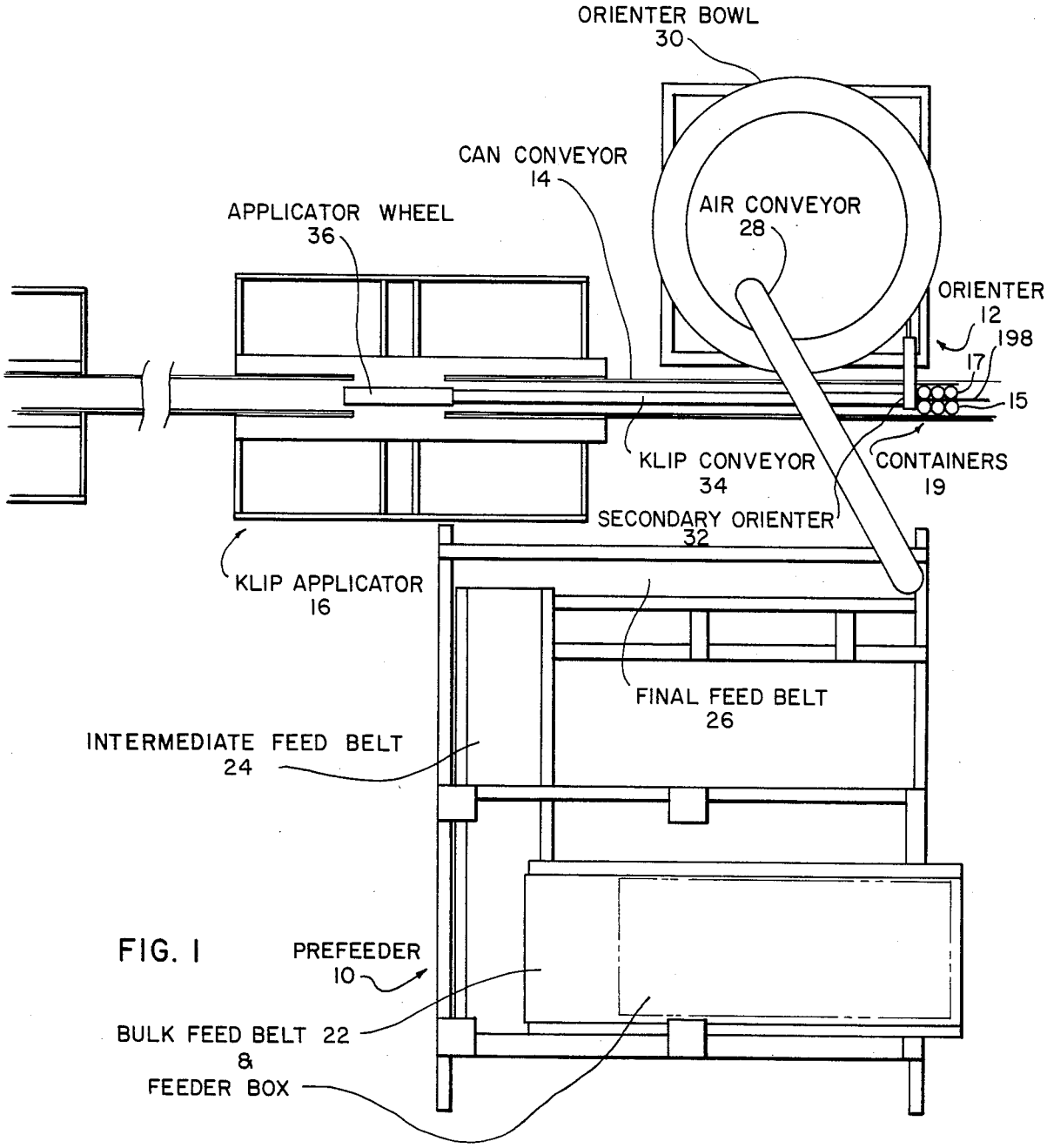
FIG. 1 is a schematic plan view of a portion of the apparatus.
Figure 2:
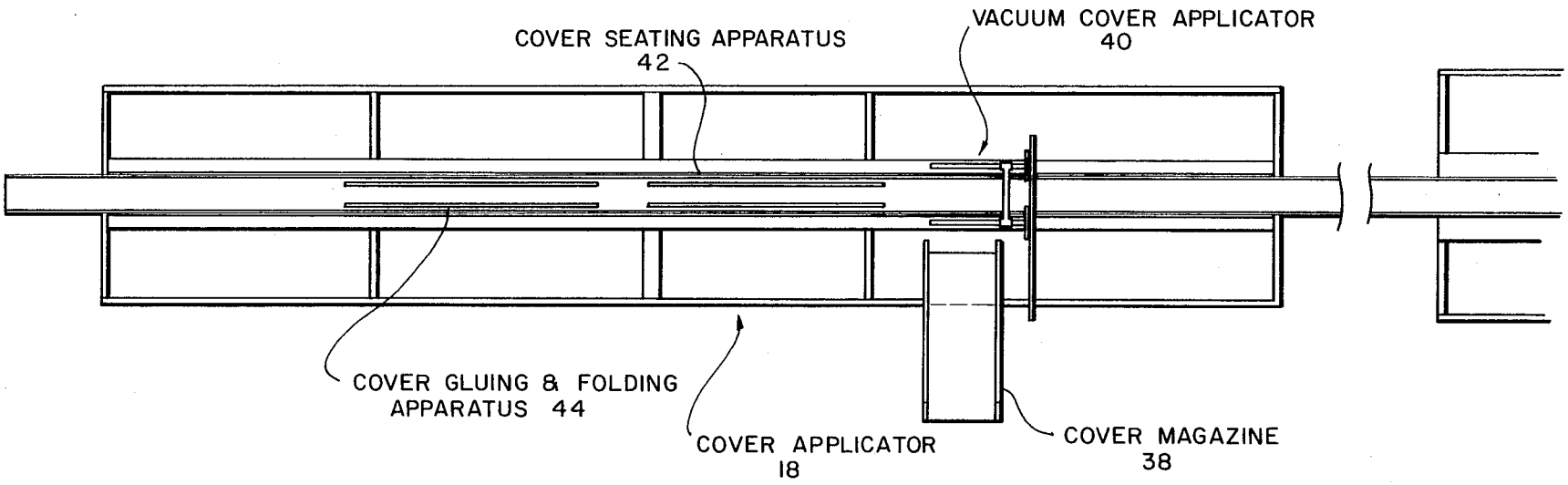
FIG. 2 is a schematic plan view of another portion of the apparatus of FIG. 1.

In general, as schematically shown in FIGS. 1 and 2, the apparatus of the present invention comprises individual container infeed conveyor means comprising can conveyor 14 for laterally moving two parallel rows 15, 17 of separate unattached individual containers 19 located in closely spaced generally abutting relationship, as shown in FIG. 1, from a container supply source (not shown) to clip applicator means 16 which applies clips to the cans. Container group separating means are associated with the container infeed means for longitudinally and transversely separating the separate unattached generally abutting containers to define at least one central gap therebetween suitable for mounting a clip. A clip conveyor means 34 is provided for transporting clips in single file to the clip applicator means 36 from a clip orienter means 12 and prefeeder means 10 whereat the clips are oriented and arranged in single file relationship. An air conveyor means 28 may be provided for transporting clips from the prefeeder means 10 to the clip orienter 12. After the clips have been applied to the cans to form multiple container packages, the container packages are transported away from the clip applicator means 16 by a conveyor which separate and uniformly space the container packages. The container packages are then transported to cover applicator means 18 which applies cover members to the multiple container packages. The cover applicator means 18 comprises vacuum cover applicator means 40, cover seating means 42 and cover gluing and folding apparatus 44.

Referring to FIG. 1, the clips are received in a bulk loaded container and an operator transfers the clips into a large capacity feeder box 20 for maintaining accumulation inventory. The clips are fed from feeder box 20 onto bulk feed belt 22 which supplies a controlled volume of clips having a predetermined distribution. The clips are fed from bulk feed belt 22 to a transverse intermediate feed belt 24 which is located below the bulk feed belt 22. Intermediate feed belt 24 is operated at a faster speed than bulk feed belt 22 so that the clips are spread out and consequently obtain greater orientation. Final feed belt 26 is located below intermediate feed belt 24 so that the clips from intermediate feed belt 24 are deposited on final feed belt 26. Final feed belt 26 is operated at a higher speed than intermediate feed belt 24 and further spreads the clips to obtain a more refined distribution. Air conveyor 28 transports the clips from final feed belt 26 to orienter bowl 30. The clips are oriented by centrifugal force along the outer rim of the rotating orienter bowl 30. The clip configuration dictates a pattern of orientation and any unoriented parts are segregated and returned to the bowl for re-orientation. Orienter bowl 30 is more fully disclosed in U.S. Pat. Nos. 3,669,260; 3,722,674; 3,826,405; 3,831,734; 3,900,107; 3,912,120 and 3,986,636 issued to Hoppmann et al., the disclosure of which are specifically incorporated by reference.

Clips which have been oriented on the outer rim of the orienter bowl 30 leave the orienter bowl 30 in a horizontal direction along a tangential track leading to secondary orienter 32. Secondary orienter 32 comprises a track which functions to change to the direction of the clip from horizontal to vertical while changing the clip orientation from a diagonal cross (XXXXX) orientation to a vertical cross (+++++) orientation. Clip applicator 16 requires that the clips be placed in a +++++ configuration for proper application to the cans.

After the clips leave the secondary orienter 32 they are placed on a clip conveyor 34 which conveys the clips to applicator wheel 36 which applies the clips to cans transported by can conveyor 14. The assembled cans leave clip applicator 16 and are transported to cover applicator 18 as illustrated in FIG. 2. Cover magazine 38 holds a stack of skirted covers to be applied to the assembled cans. Vacuum cover applicator 40 removes the covers from cover magazine 38 and places them on the assembled can groups. Cover seating apparatus 42 seats the cover by inserting a plunger in the finger hole aperture of the cover which is aligned with the finger aperture of the clip, so that the cover aperture provides a locking mechanism with the finger apertures of the seat.

Cover gluing and folding apparatus 44 folds the skirted edges of the cover around the peripheral portions of the assembled can groups and applies glue to these portions to hold them in place. The assembled and covered groups of cans are then transported from the cover applicator 18.

Figure 3:
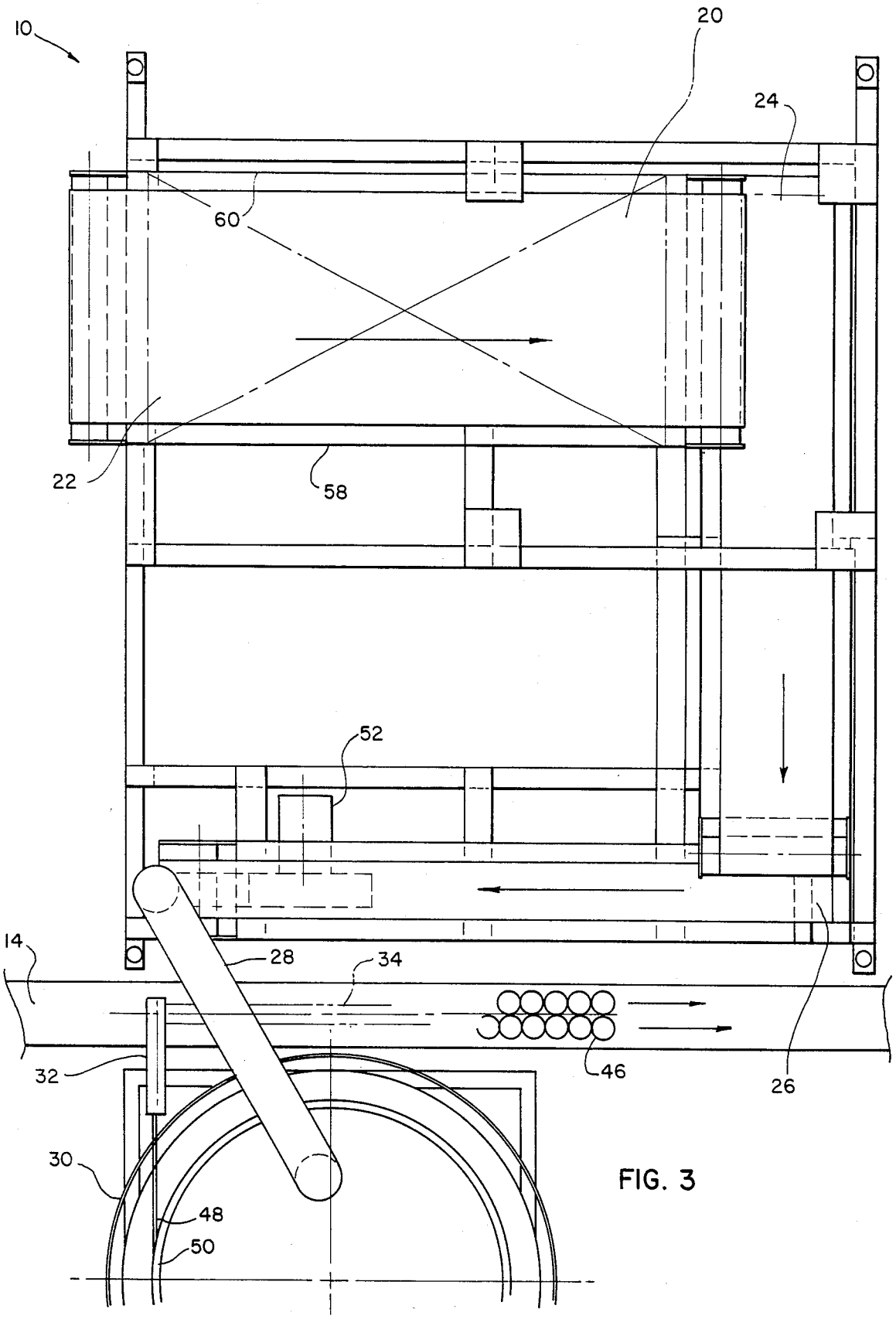
FIG. 3 is a schematic plan view of the prefeeder illustrated in FIG. 1.

FIG. 3 discloses a schematic plan view of prefeeder 10. Clips from feeder box 20 are fed on demand to bulk feeder belt 22. Bulk feeder belt 22 has a large accumulation of nested clips and distributes them on demand to intermediate feed belt 24. Clips from feeder box 20 flow randomly onto bulk feed belt 22, i.e., in nested groups. Hopper walls 58 and 60 allow bulk feed belt 22 to hold approximately 15 cubic feet of clips, a rake (not shown) is located over the end of bulk feed belt 22 and rotates in a direction opposite to the direction of bulk feed belt 22 to limit the number of clips deposited on intermediate feed belt 24. Intermediate feed belt 24 is narrower and runs faster than bulk feed belt 22 so that clips deposited on intermediate feed belt 24 have a general refined distribution. A more refined distribution of clips is achieved on final feed belt 26.

Figure 4:
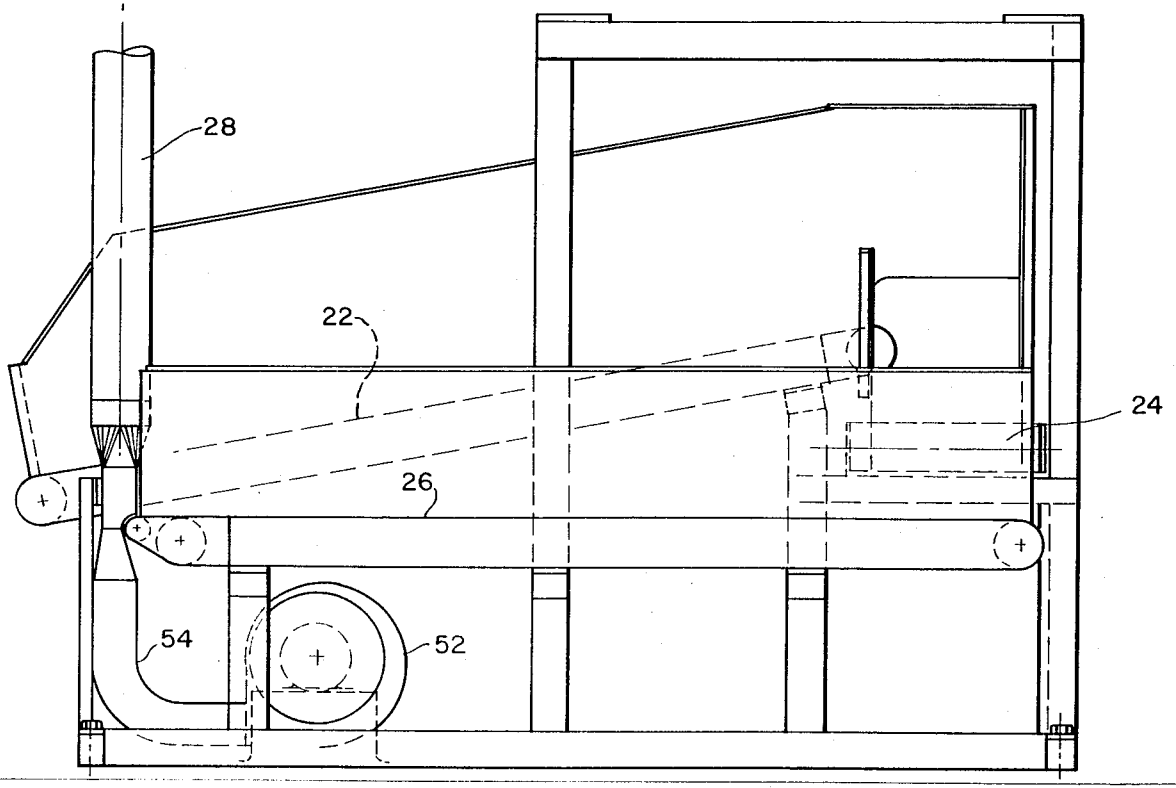
FIG. 4 is a schematic elevation view of the device illustrated in FIG. 3.

FIG. 4 is a schematic elevation view of the device of FIG. 3. Air conveyor 28 is aligned with plenum 54 which directs air from blower 52 across the end of final feed belt 26. Clips are directed through air conveyor 28 from the end of final feed belt 26 by the positive pressure air directed from plenum 54 into air conveyor 28. The clips are moved along the entire length of air conveyor 28 by the flow of air supplied by fan 52.

Figure 5:
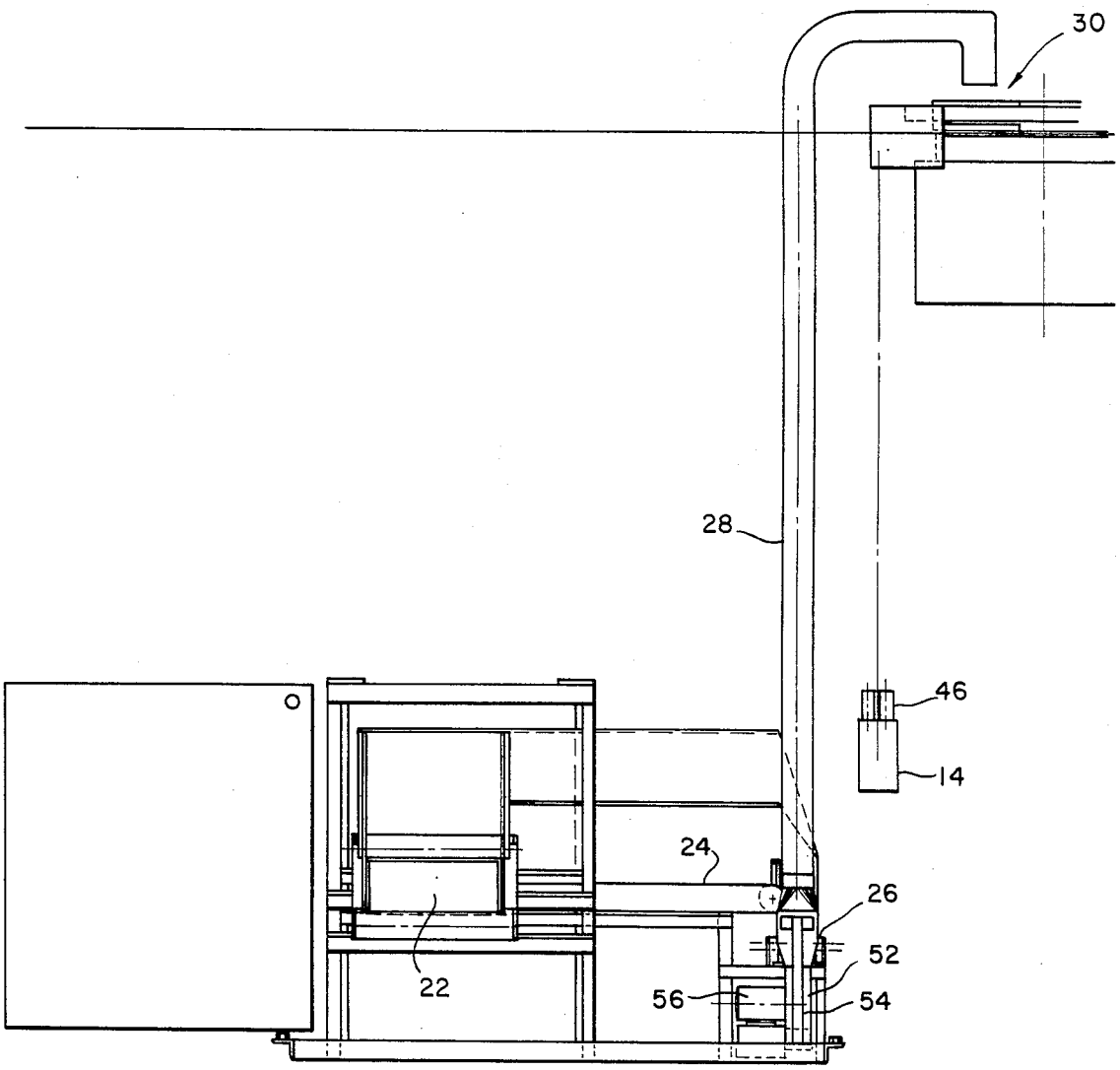
FIG. 5 is an elevation view of the prefeeder illustrated in FIGS. 3 and 4.

FIG. 5 discloses an elevation view of the prefeeder 10 illustrated in FIGS. 3 and 4. Fan motor 56 is coupled to blower 52 to supply the mode of power to rotate fan 52. Air is directed through plenum 54 in a manner illustrated in FIG. 5. The clips are transported a predetermined vertical distance in air conveyor 28 for deposit in orienter bowl 30.

Basically, orienter bowl 30 is a centrifugal orienter which provides a demand signal for supplying clips from air conveyor 28. Whenever the orienter bowl 30 is full, the orienter bowl 30 produces a control signal to shut off final feed belt 26, intermediate feed belt 24, bulk feed belt 22, and controls feeder box 20 so that no additional clips are deposited on bulk feed belt 22. Orienter bowl 30 has a base plate which is inclined at a predetermined angle. The base plate rotates around an axis and produces a centrifugal force which causes the clips to be deposited against the stationary outer wall of orienter bowl 30. The clips are designed so that a large percentage of clips are deposited on the stationary outer wall with clip ears facing the center of the orienter bowl. An air jet is provided through a small orifice in the stationary outer wall causing clips which are not oriented properly, i.e., ears facing the outer wall, to be blown back into the bowl for re-orientation. The rotating base plate is aligned with a rotating rim at the highest elevation point of the rotating base plate. The rotating rim is disposed horizontally around the outer wall of orienter bowl 30 and is aligned with a tangential track 48 formed in the outer wall. The orifice through which air is applied to cause the clips to be blown back into the orienter bowl are disposed in a location in the outer wall prior to the tangential track. The rotating rim cause the clips which are properly oriented to be moved along the outer wall in the same direction as the rotation of the rim until they reach the tangential track 48 where they exit the orienter bowl properly oriented in an XXXXX configuration. The tangential track is coupled to the secondary orienter 32, illustrated in FIG. 6.

Figure 6:
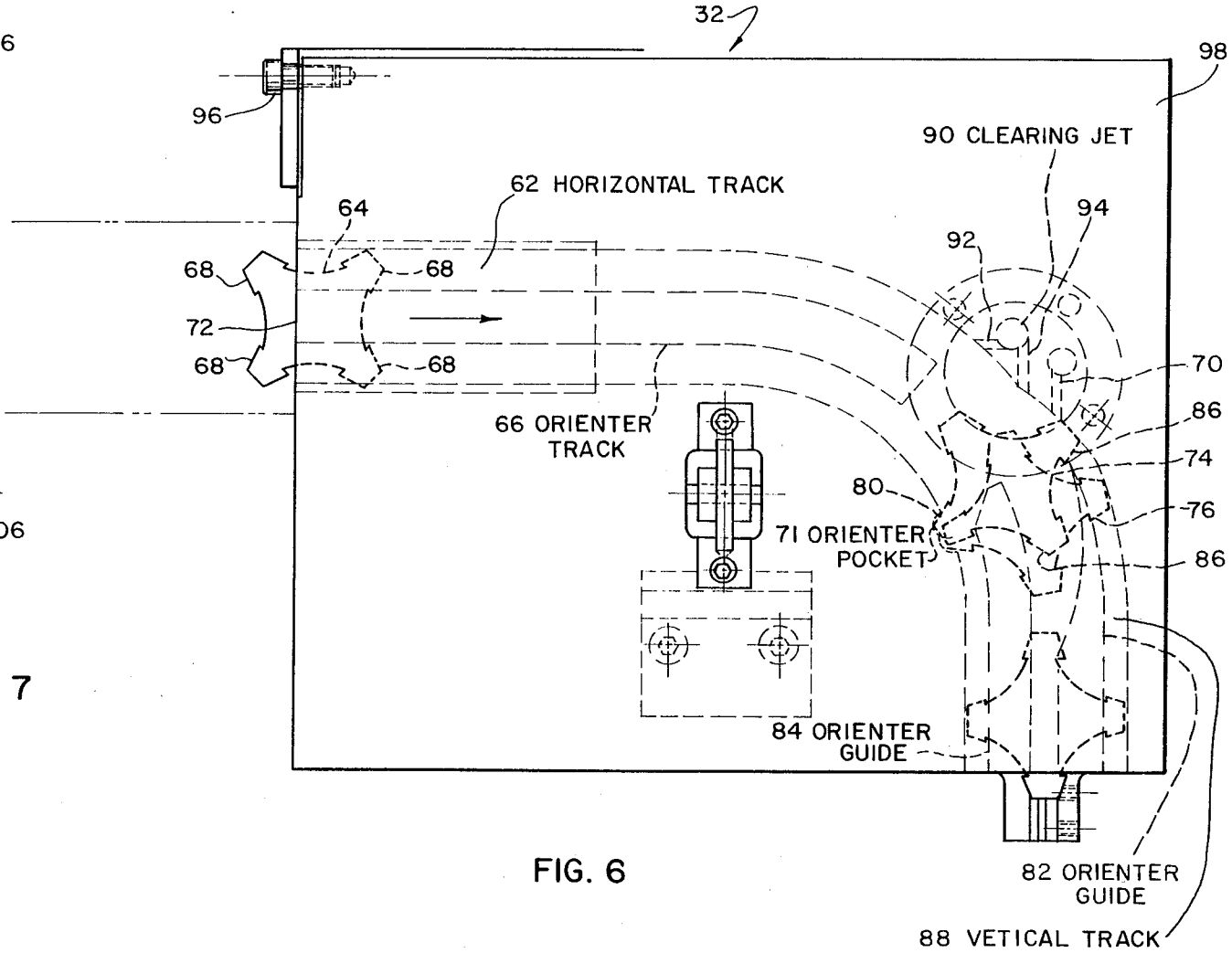
FIG. 6 is an elevation view of the secondary orienter.

FIG. 6 illustrates the secondary orienter which accepts clips leaving the bowl in an XXXXX configuration traveling in a horizontal direction at a velocity equal to the tangential bowl rim velocity. Clips enter the horizontal track 62 of secondary orienter 32 in a manner illustrated by clip 64. The purpose of the secondary orienter 32 is to (a) change direction of the clip travel from horizontal to vertical, and (b) change the orientation of the clips from an XXXXX configuration to a +++++ configuration, since the clip applicator machine requires the clips to be oriented in a +++++ configuration.

Reorientation of the clips is accomplished by accelerating the clips in the horizontal track to provide spatial separation and propelling the clips through a 90° bend to achieve vertical orientation. Clip 64 is held in an XXXXX configuration by orienter track 66 which comprises a raised surface which ear portions 68 of clip 64 align during travel along horizontal track 62. Acceleration of the clips is accomplished by directing compressed air through an orifice 70 which induces a negative pressure at entrance 72 of horizontal track 62. The negative pressure at entrance 72 provides a suction force to draw the clips into horizontal track 62 and accelerate them through secondary orienter 32. The clip enters the 90° turn and follows the contour of the track as it proceeds around the bend illustrated in FIG. 6. The clip leaves the orienter track 66 and the leading set of ears 80 of clip 74 become disposed in orienter pocket 71. As ears 80 are disposed in orienter pocket 71, the clip motion is retarded and achieves a rotational motion in orienter pocket 71. The rotational motion of clip 74 is guided by ears 86 disposed in orienter guides 82, 84. Air jet 70 assists in moving clip 74 by applying pressurized air against ears 86 to aid in movement and rotation of clip 74. Air jet 70 and orienter pocket 71 function together to finally orient the clip, such as shown by clip 76, in orienter guides 82 and 84. Air jet 70 keeps the clips moving in vertical track 88.

Another feature of the secondary orienter 32 is its ability to segregate bad clips. On occasion, the clips are short shot, i.e., the ears are not filled out, or damaged clips are found in the system. During operation, the secondary orienter isolates the bad clips. Bad clips have a tendency to jam at the turning point in secondary orienter 32. The secondary orienter 32 is capable of detecting the occurrence of jams by sensing a lack of clips downstream when a supply of clips is available upstream. Secondary orienter 32 has a cover plate 98 which is hinged at 96 to open when compressed air is applied simultaneously to clearing jet 90 and air cylinder 100. Orifice 94 provides compressed air to purge secondary orienter 32 of bad clips. Orifice 92 simultaneously provides a flow of compressed air upstream to retard clips from entering secondary orienter 32.

Figure 7:
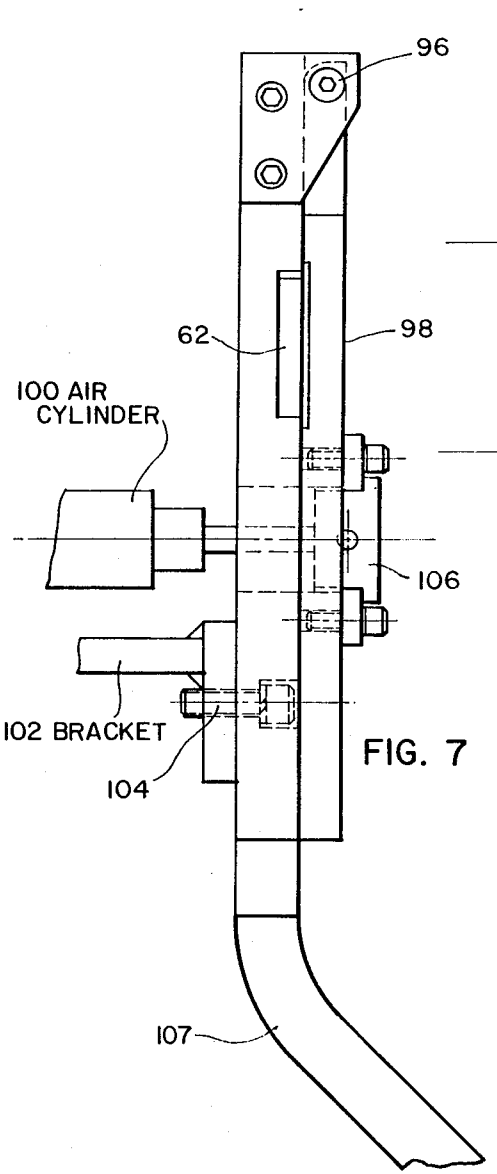
FIG. 7 is a side elevation view of the secondary orienter illustrated in FIG. 6.

FIG. 7 is a side elevation view of the secondary orienter 32 illustrated in FIG. 6. As shown is FIG. 7, cover plate 98 swivels on hinge 96 whenever air cylinder 100 is actuated to abut against bracket 106. Bracket 102 is secured to secondary orienter 32 by bolt 104. Bracket 102 supports secondary orienter 32 such that horizontal track 62 is aligned with the tangential track of orienter bowl 30.

Track 107 is attached to vertical track 88 of secondary orienter 32 and accepts clips in a free fall mode oriented in a + + + + + configuration and changes the vertical direction of the free falling clips to a 45° angle. Track 107 is coupled to the clip conveyor 118 illustrated in FIGS. 9 and 10.

Figure 8:
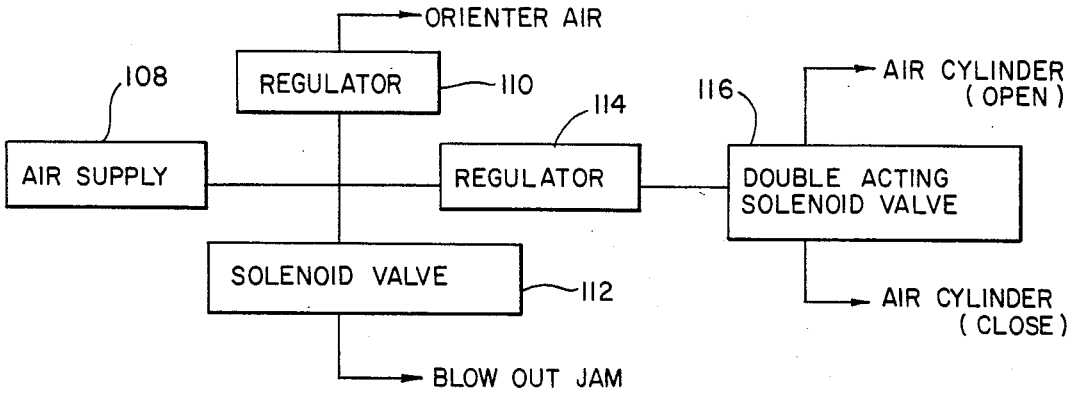
FIG. 8 is a schematic block diagram of the pneumatic control system utilized with the secondary orienter.

FIG. 8 is a schematic block diagram of the pneumatic control system utilized in conjunction with secondary orienter 32. A supply of compressed air 108 is applied to regulator 110 which controls the flow of air through orifice 70. Air supply 108 is also applied to regulator 114 which regulates the flow of air to double acting solenoid valve 116 which channels the supply of compressed air to either open or close air cylinder 108. The supply of compressed air 108 is also applied to solenoid valve 112 which controls the flow of air to clearing jet 90 to blow out jammed clips.

Figure 9:
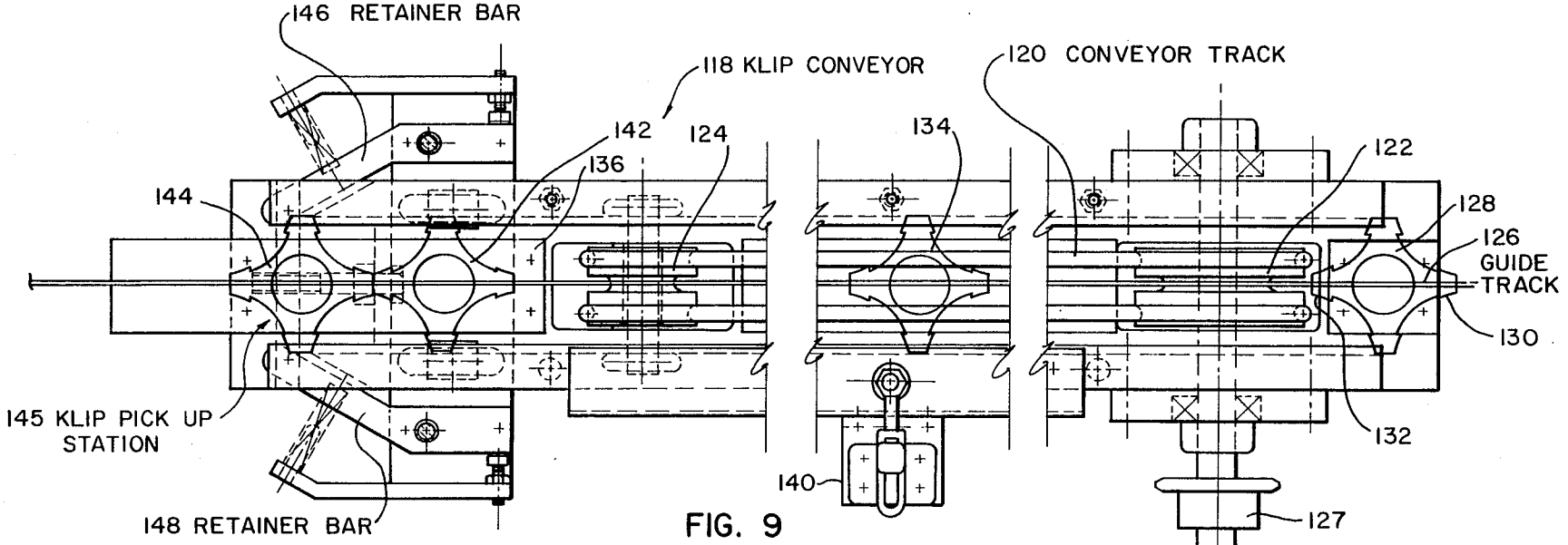
FIG. 9 is a plan view of the clip conveyor.

FIG. 9 is a plan view of the clip conveyor 118. The conveyor track 120 is driven on conveyor pulleys 122, 124. Conveyor pulley 122 is driven by power drive 126. The clips entering clip conveyor 118 are aligned in a + + + + + configuration, such as illustrated by clip 128, so that central slots formed between ears 130, 132 ride on guide track 126. The clips proceed down the conveyor track 120 such as shown by clip 134, and are deposited on stationary plate 136. Clips are driven from position 142 to position 144 from upstream clips on conveyor track 120 and the action of gravity since clip conveyor 118 is disposed at approximately a 45° angle. Sensors (not shown) detect the presence of clips on clip conveyor 118 to control the action of conveyor track 120.

Figure 10:
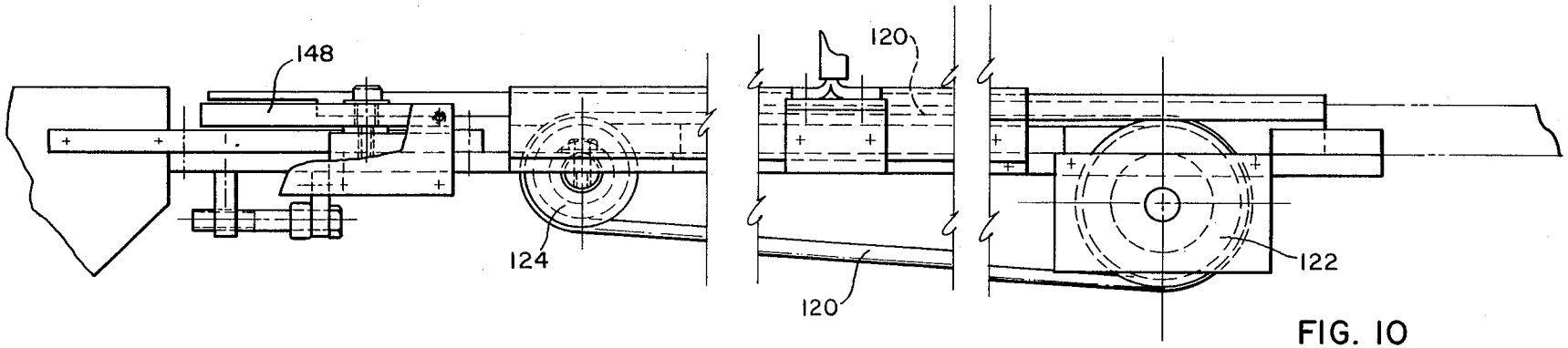
FIG. 10 is an elevation view of the clip conveyor illustrated in FIG. 9.

FIG. 10 is an elevation view of clip conveyor 118 illustrating conveyor pulleys 122, 124 and conveyor track 120. Although clip conveyor 118 is shown horizontally disposed in FIG. 10, it is actually disposed at approximately a 45° angle, as shown in FIG. 11.

Figure 11:
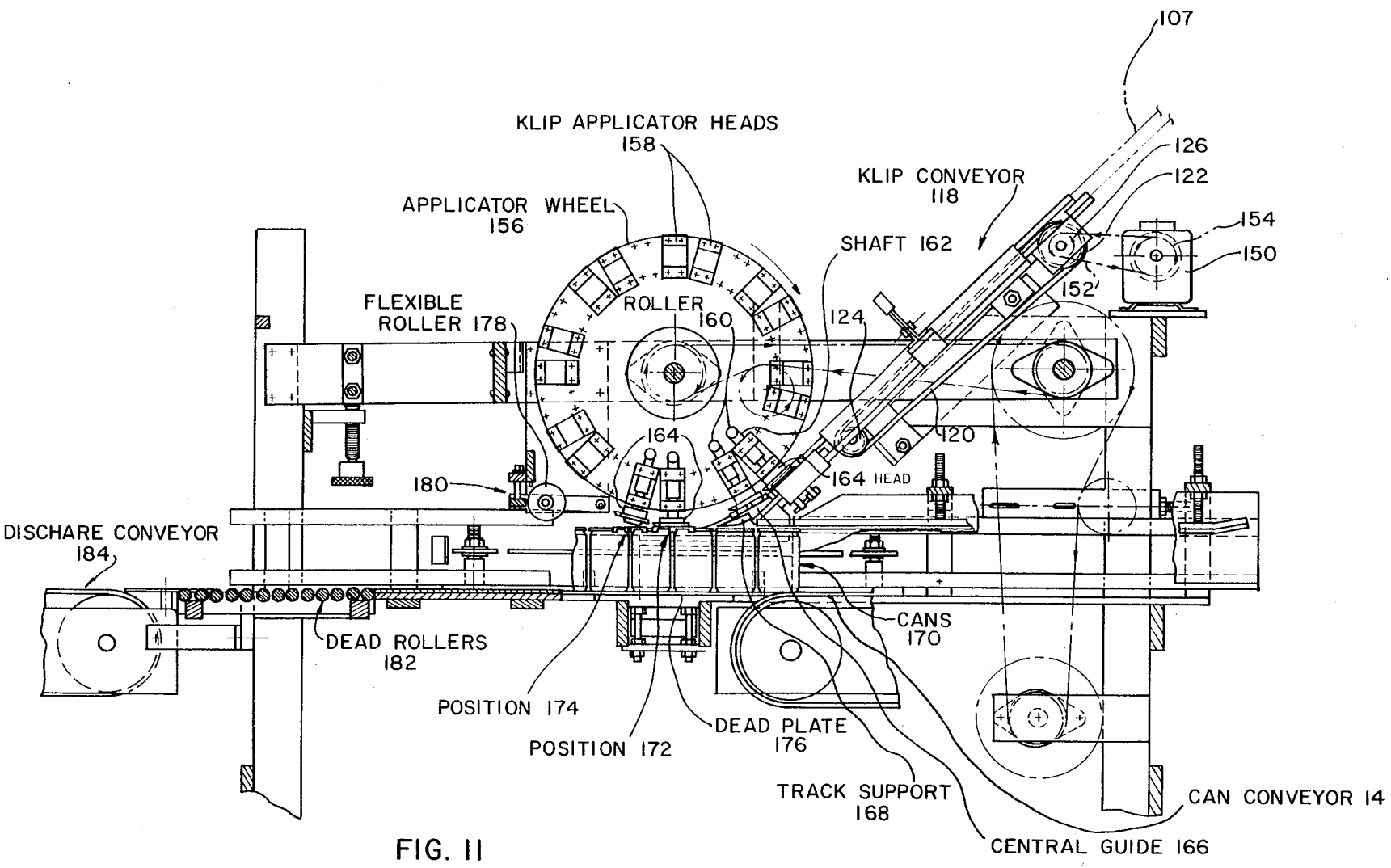
FIG. 11 is an elevation view of the clip applicator mechanism.

FIG. 11 is an elevation view of the clip applicator mechanism. The clip conveyor 118 is disposed at an essentially 45° angle. Conveyor track 120 is driven on conveyor pulleys 122, 124 by power supplied from motor 150. Drive pulleys 126, 154 are coupled by drive belt 152. Track 107 is coupled directly to the input of clip conveyor 118 at approximately the same 45° angle. Applicator wheel 156 has a plurality of clip applicator heads 158 disposed around its circumference and spaced in a predetermined configuration to make up the package configuration desired, i.e., 4-pack, 6-pack, etc. Applicator wheel 156 rotates in the direction indicated such that clip applicator heads 158 pass directly over clip pick up station 145 where clips such as clip 144, illustrated in FIG. 9, are retained by retainer bars 146, 148. Rollers 160 are disposed in a cam track (not shown) as applicator wheel 156 rotates in a clockwise direction. The cam drives roller 160 in a downward and outward direction which in turn drives shaft 162 and head 164 in a downward and outward direction such that head 164 enters the clip finger hole at clip pick up station 145. The motion of applicator wheel 156 causes head 164 to provide sufficient force to overcome the force of retainer bars 146, 148 to remove clip 144 from clip pick up station 145. As the clip leaves the clip conveyor 118, it is positioned by a central guide 166 which meshes with a longitudinal track of the clip to maintain proper orientation. The clip travels along the circumferential path of applicator wheel 156 in central guide 166 supported at its outer edges by track support 168 such that the tangential velocity of the drum is equal to the linear velocity of cams 170. The rotation of applicator wheel 156 moves the clip into position 172 where roller 160 is again cam actuated to move head 164 vertically downward relative to the tops of cans 170. This cam action presses the clip onto the can at position 172 by forcing the radial hook of the clip around the chime of the can so that it is seated on the roll at the lower periphery of the chime. As applicator wheel 156 continues to rotate to position 174, head 164 is retracted by the cam action of roller 160 to remove head 164 from the clip which is secured to the cans. Dead plate 176 provides a stable surface on which the cans are positioned during application of the clip.

Flexible roller 178 is a free wheeling roller which can be adjusted by assembly 180 to provide an interference fit between flexible roller 178 and cans 170. The cans are then driven by the force of upstream cans to dead rollers 182 and finally to discharge conveyor 184 which picks up the groups of cans and conveys them to either a subsequent station such as a packer or to a cover applicator such as illustrated in FIGS. 16 through 29.

Figure 13:
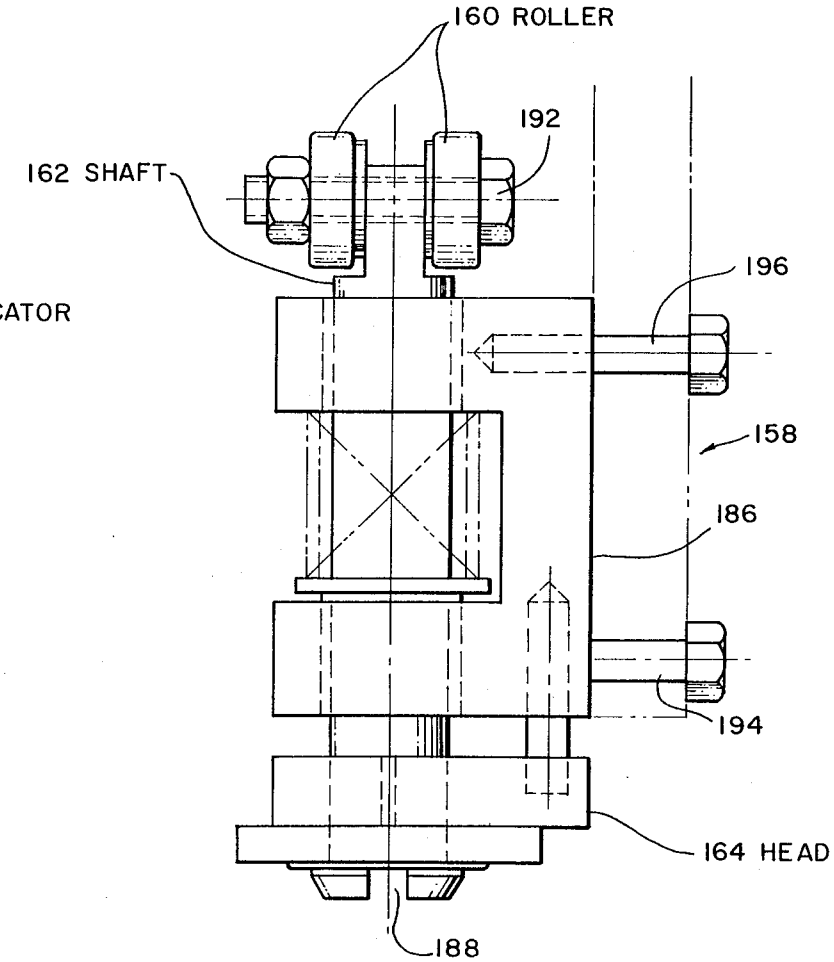
FIGS. 12 and 13 are elevation views of clip applicator heads.
Figure 12:
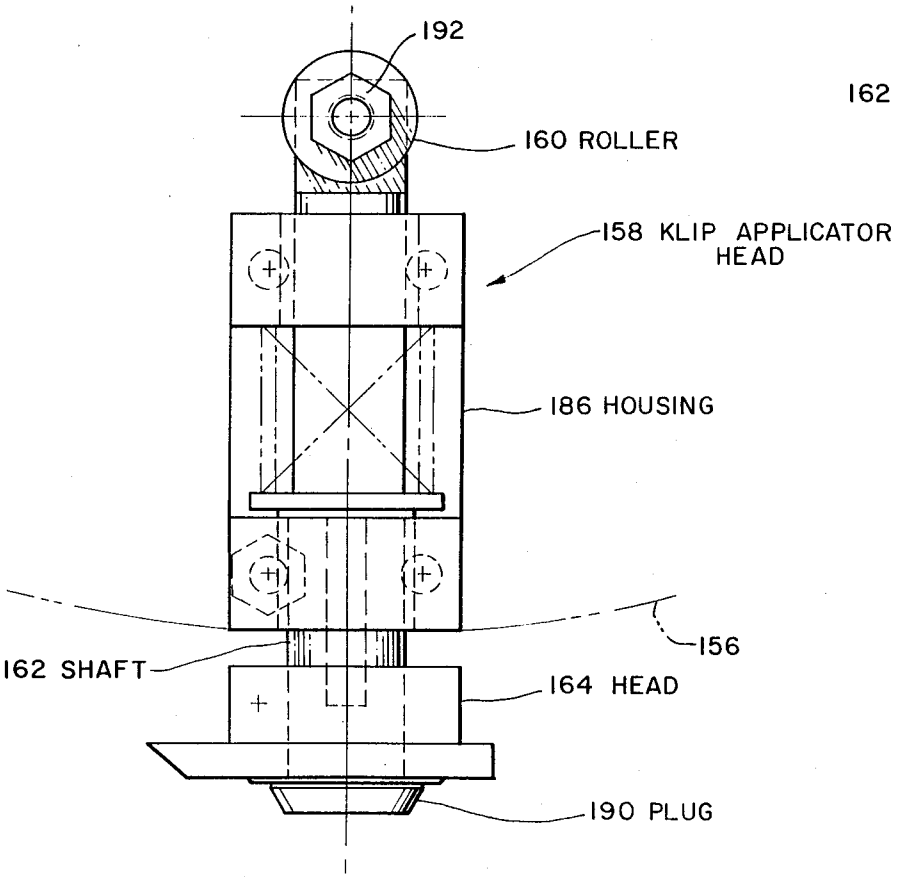

FIGS. 12 and 13 illustrate elevation views of clip applicator heads 158. Bolt 192 secures rollers 160 to shaft 162 which moves in and out of housing 186 in response to force provided by a stationary cam positioned adjacent to applicator wheel 156. Shaft 162 is connected to head 164 which has a plug 190 which fits into the finger holes of the clip to be secured to the cans. Housing 186 is secured to applicator wheel 156 by screws 194,196.

Figure 14:
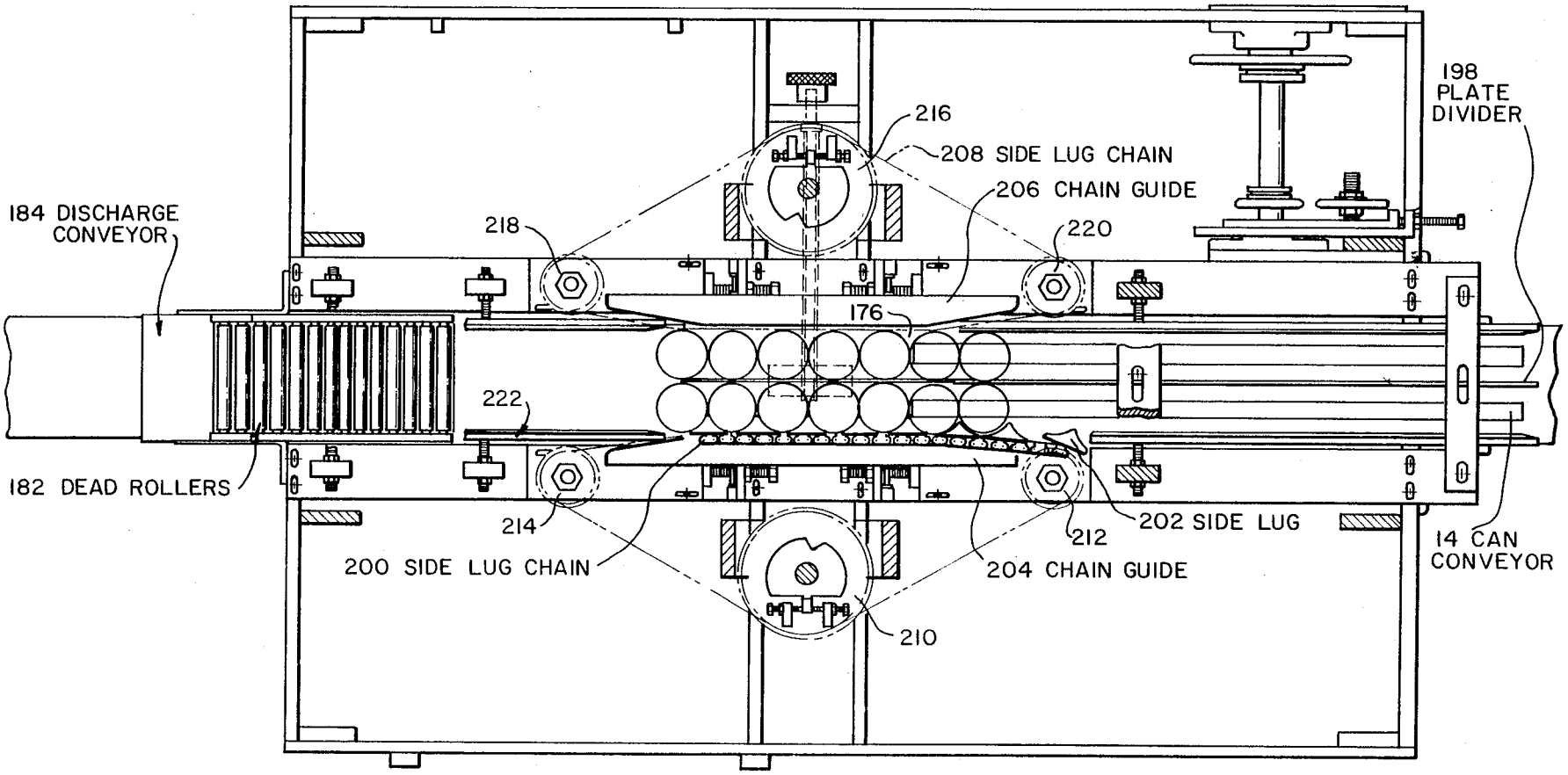
FIG. 14 is a plan view of the clip applicator illustrated in FIG. 11.

FIG. 14 discloses a plan view of the clip applicator 16. As illustrated in FIG. 14, pairs of cans aligned side by side enter clip applicator 16 by way of can conveyor 14. Plate divider 198 provides approximately 1/16 inch clearance between each of the pairs of cans in a direction transverse to the direction which the cans proceed on can conveyor 14. As the pairs of cans proceed down can conveyor 14 the cans engage side lugs 202 attached to side lug chain 200 which function to position the cans in a direction which is longitudinal (parallel with) the direction of travel of cans and provide spacing between the cans for proper mesh with the clips to be applied by applicator wheel 156. Side lugs 202 and side lug chain 200 are disposed on both sides of can conveyor 14. Once the side lugs 202 have engaged the cans, the can conveyor 14 terminates and the cans are guided onto dead plate 176 along which the bottom of the cans slide in response to movement of side lug chain 200. Chain guides 204, 206 ensure the proper fit of side lug 202 with the cans and that the proper spacing is achieved between the cans. Again, dead plate 176 is utilized to provide a rigid stable surface for applying the clips. Side lug chain 200 is driven by drive sprocket 210 and guided by free wheeling sprockets 212, 214. Similarly, side lug chain 208 is driven by side sprocket 216 on free wheeling sprockets 218, 220. The side lug chains 200, 208 are driven synchronously with applicator wheel 156 to ensure that the clips are aligned for application to the cans.

After the clips have been applied and flexible roller 178 passed over the tops of the clips to ensure a tight seat, side lug chains 200, 208 begin to disengage the groups of cans. Groups of cans are driven across portion 222 by the force of upstream cans being driven by side lug chains 200, 208 until they reach dead rollers 182 and are driven onto discharge conveyor 184.

Figure 15:
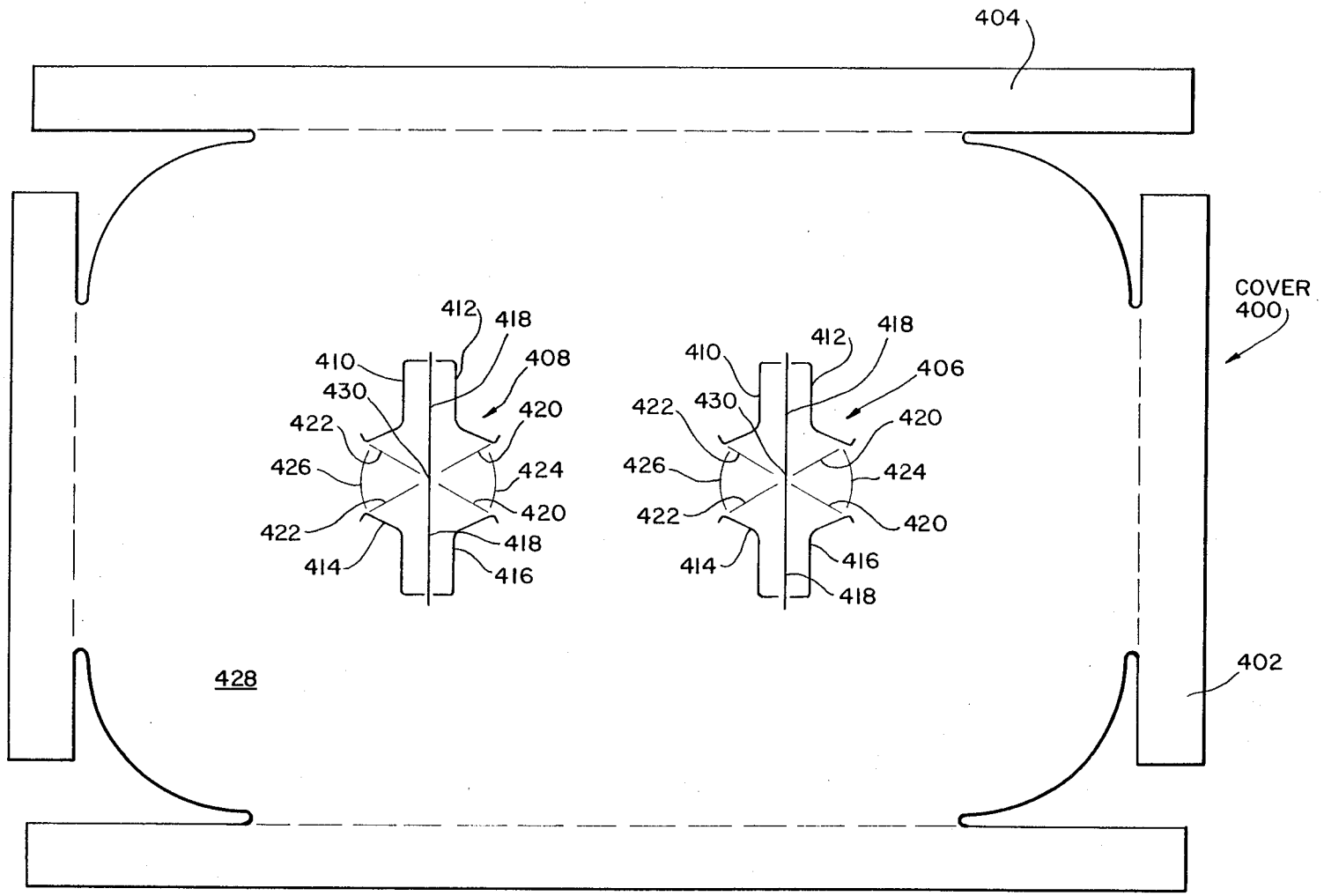
FIG. 15 is a plan view of a cover.

FIG. 15 discloses a typical cover 400 to be applied to groups of cans by cover applicator 18 such as disclosed in U.S. patent application Ser. No. 292,811, filed Aug. 14, 1981, which is specifically incorporated herein by reference. Cover 400 has skirted portions comprising short flaps 402 and longitudinal flaps 404. Portions 406 and 408 of cover 400 fit into the finger hole of the clip disclosed in the above referenced patents after the clip is applied to the cans. The cut portions 410, 412, 414, 416 and 418 separate and break away from cover body 428 when pressure is applied to the center 430 of portions 406 and 408. Folding lines 420, 422 cause each of the halves separated by center cut 418 to divide. The flaps which result from depression of portions 406, 408 at center point 430 interlock with the clip so that the cover is secured to the group of cans which are held together by the clip. Score lines 420, 422, 424 and 426 cause portions 406, 408 to form the proper configuration to interlock with the clip.

Figure 16:
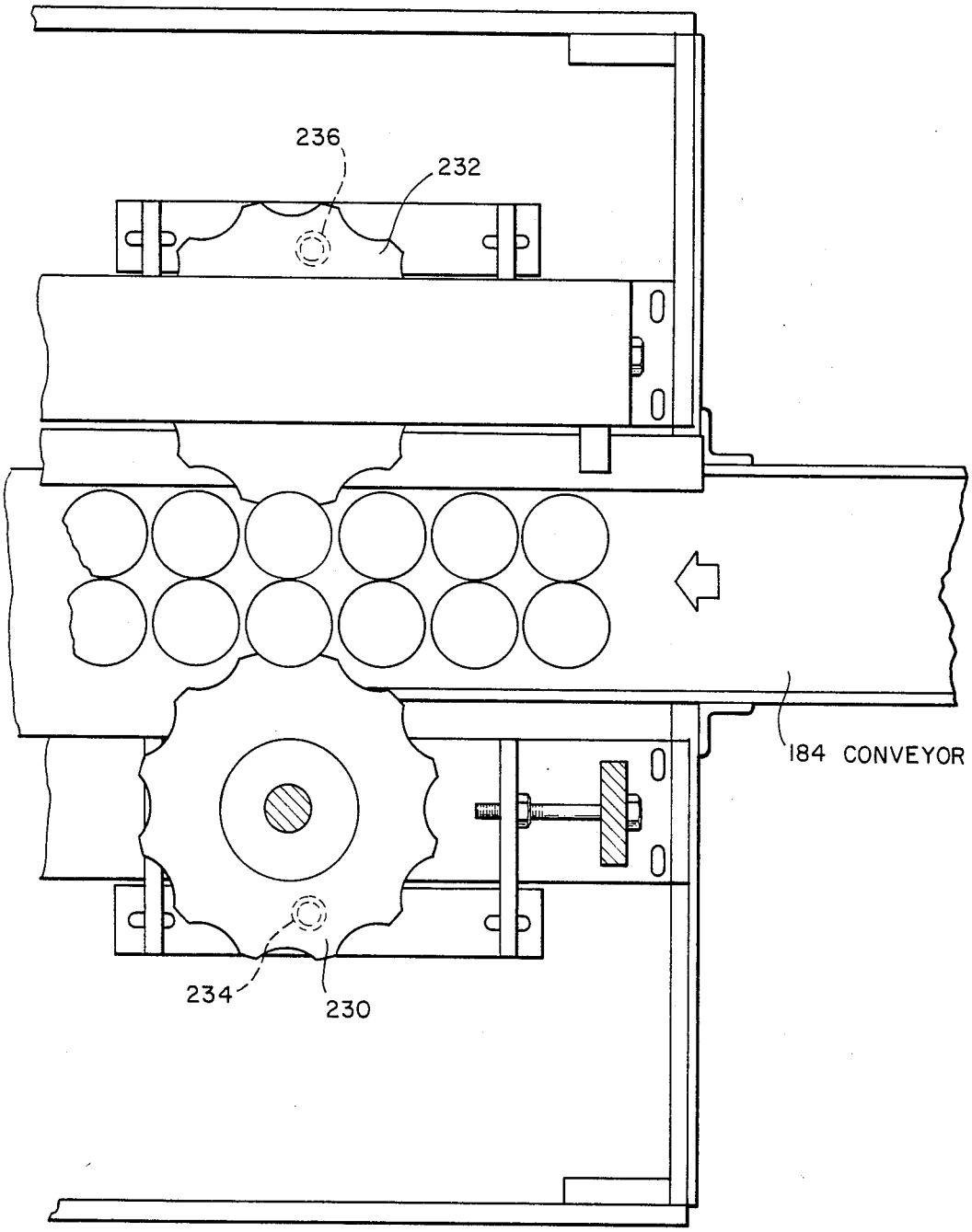
FIGS. 16–29 illustrate the cover applicator.

FIGS. 16 through 29 illustrate the cover applicator 18 of the present invention. As illustrated in FIG. 16, the groups of cans, such as 6-packs, enter the cover applicator 18 on conveyor 184 from clip applicator 16. The groups of cans are engaged by star wheels 230, 232 which comprise metering apparatus which are braked by brakes 234, 236, respectively, so that the groups of cans are in synchronization with the cover applicator machine. When the cover applicator machine requires a group of cans, brakes 234, 236 are released, conveyor 184 moves the group of cans to the next set of star wheels 238, 240, illustrated in FIG. 17. Star wheels 238, 240 have sprocket 242, 244, respectively, connected thereto which drive the chains 246, 248, respectively having lugs 250, 252 attached thereto. Lugs 250, 252 engage groups of cans, such as 6-packs, at end portions thereof and drive the groups of cans through the entire machine to obtain synchronism with the operation of the cover applicator machine 18. Conveyor 184 is driven slightly slower than the movement of lugs 250, 252 so that the groups of cans slide to some extent along conveyor 184 as they proceed through the cover applicator machine.

Figure 17:
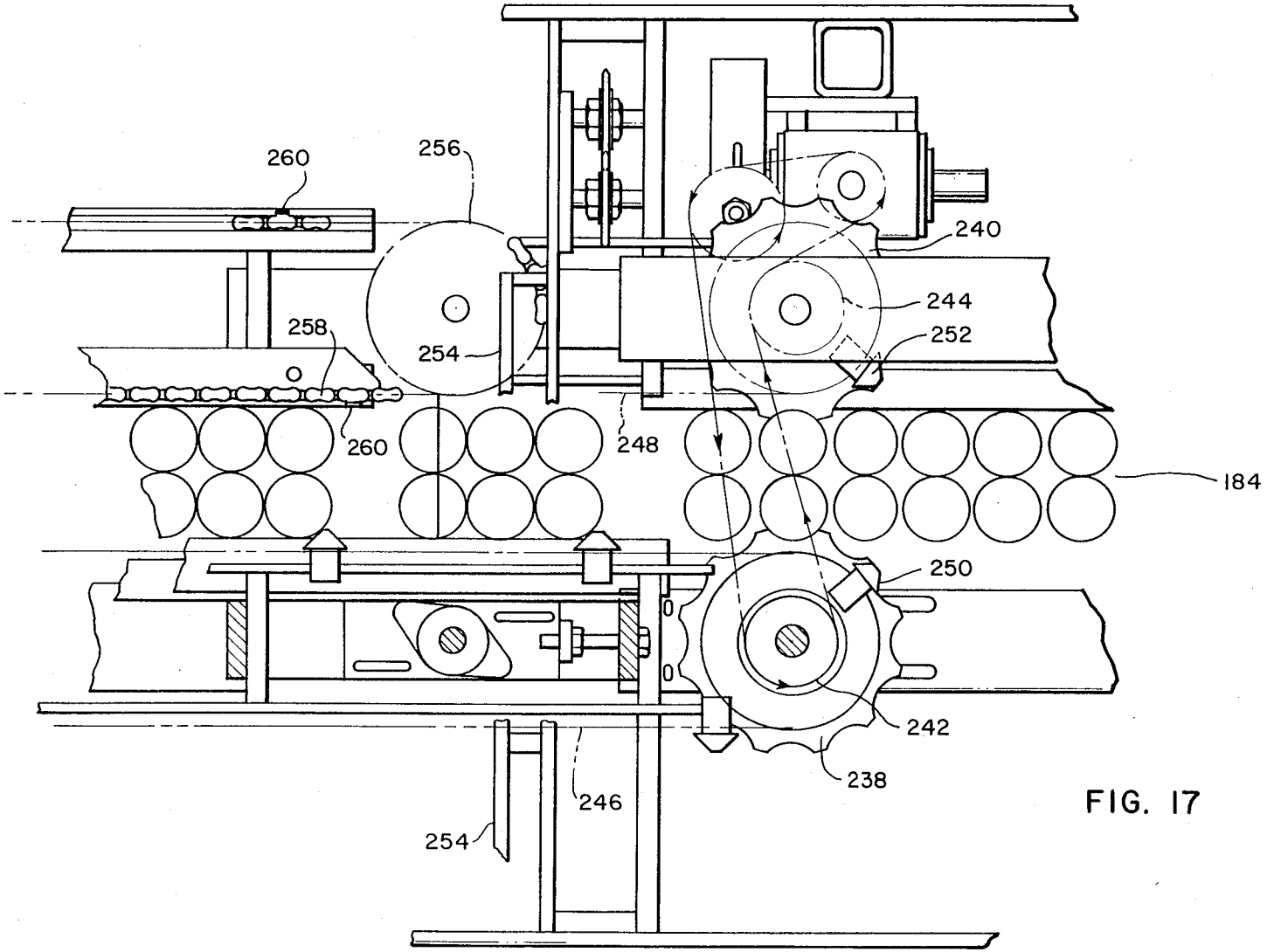
Figure 18:
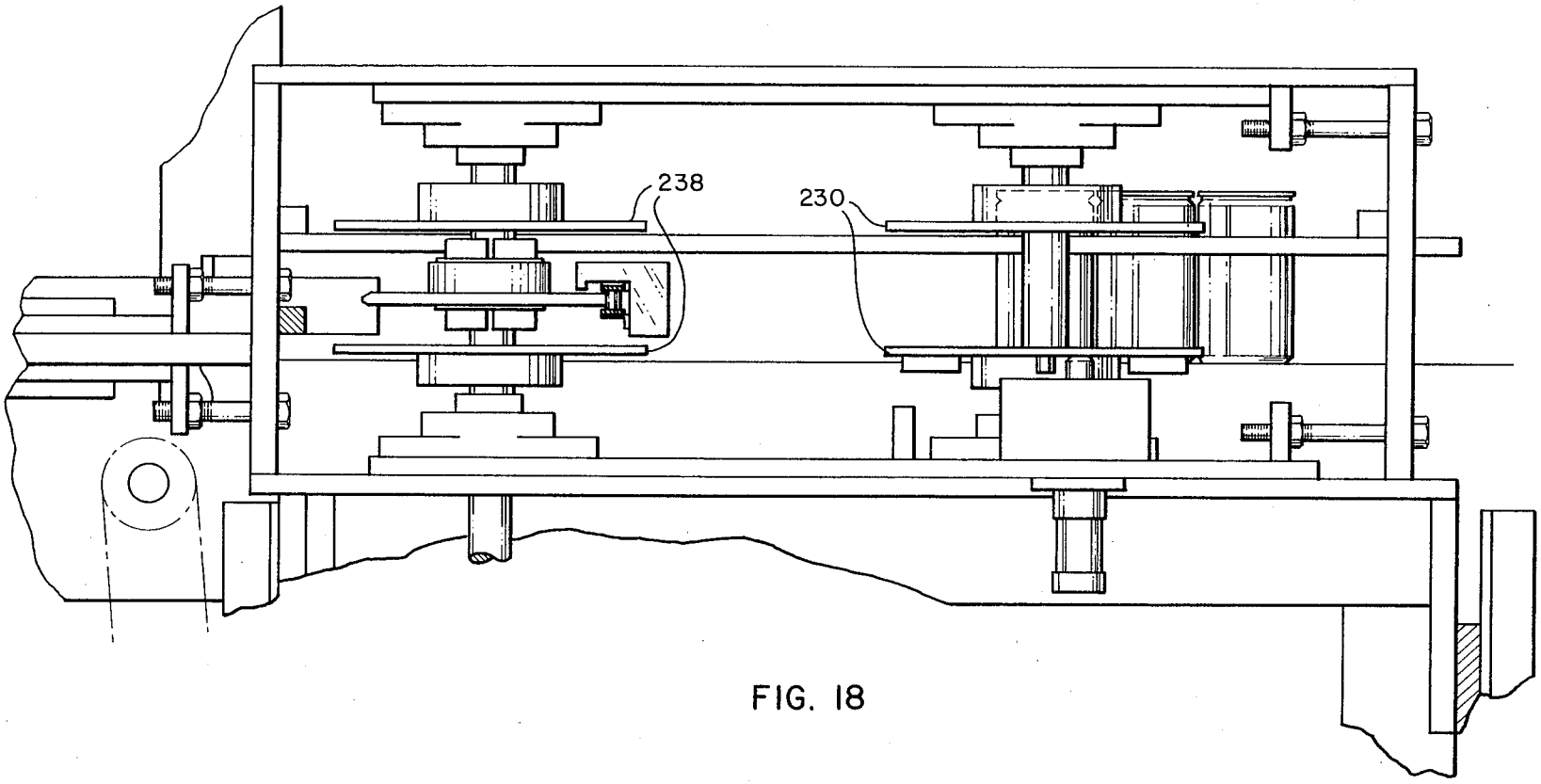

FIG. 18 is an elevation view of the apparatus illustrated in FIGS. 16 and 17. As shown in FIG. 18, star wheels 230, 238 engage the groups of cans to assure proper timing.

Referring again to FIG. 17, sprocket 256 engages chain 258 which has a series of lugs 260 which function to engage covers which have been applied to the groups of cans and advance the covers synchronously over the groups of cans as the cans are being driven by the lugs. Although shown on only one side of conveyor 184, the cover drive apparatus is disposed on both sides of the conveyor to advance the cover evenly.

Figure 19:
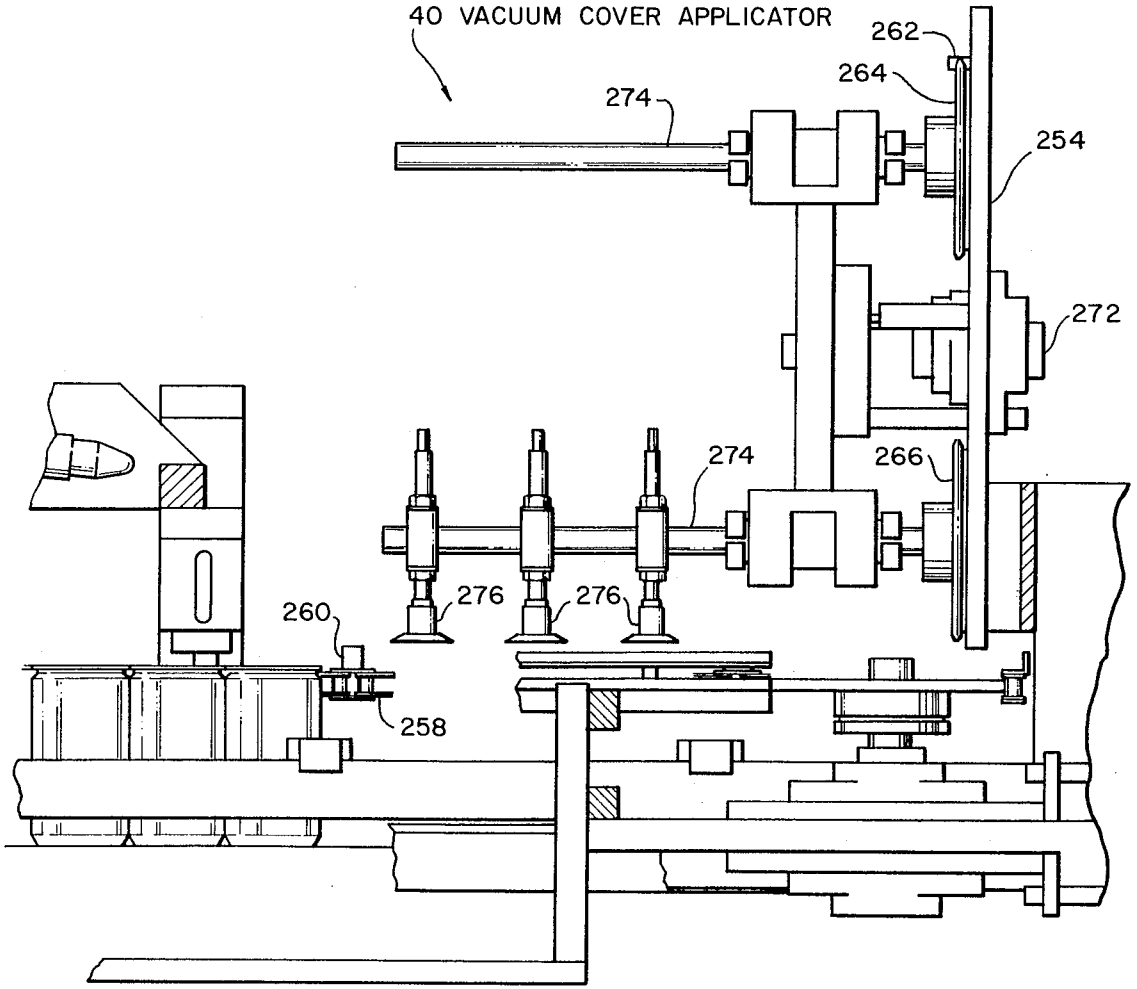
Figure 20:
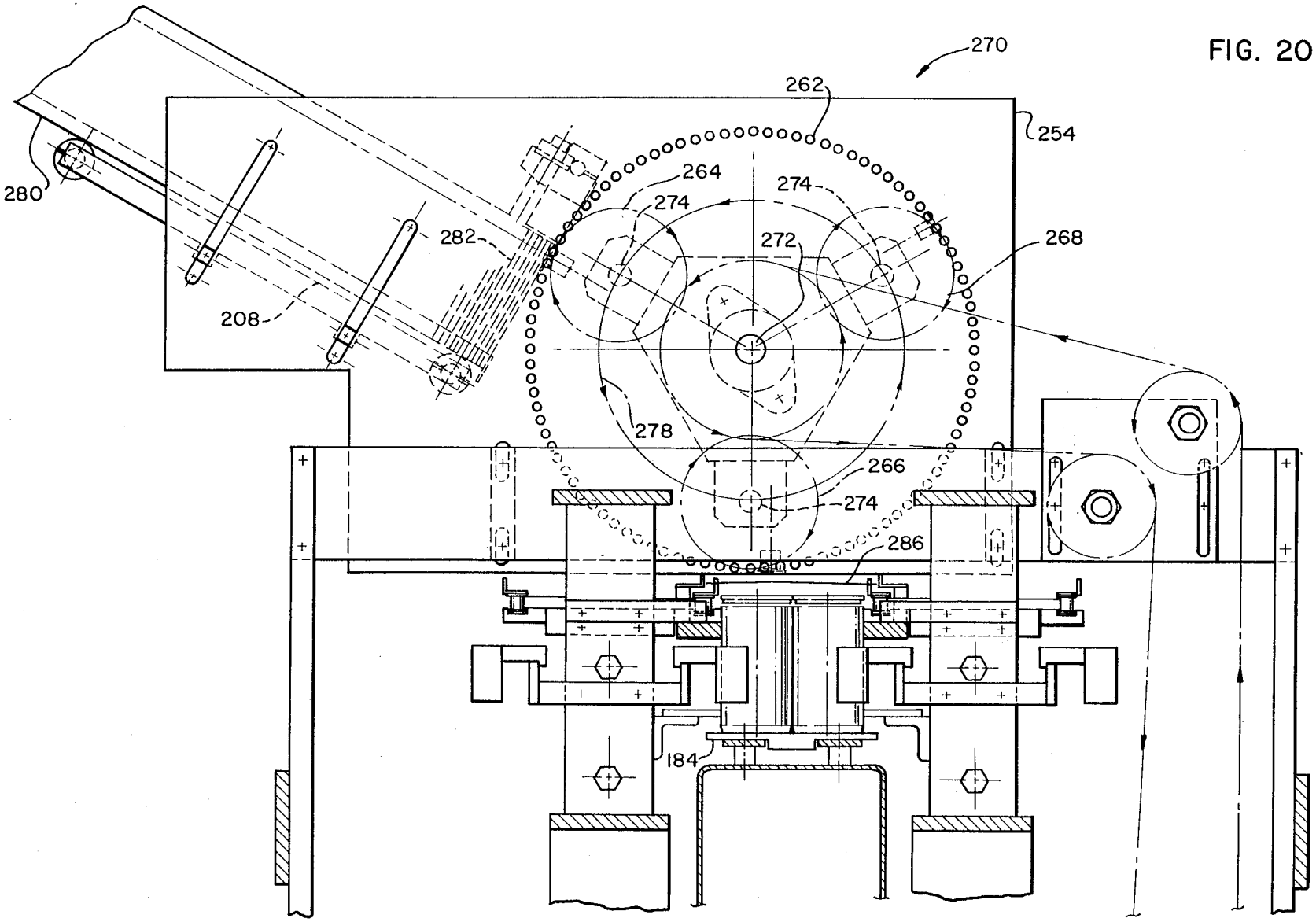

FIGS. 19 and 20 disclose the vacuum cover applicator 40 such as disclosed in U.S. Pat. No. 4,350,466 issued Sept. 21, 1982 to Bahr et al, which is specifically incorporated herein by reference. The position of plate 254 is illustrated in both FIGS. 17 and 19. FIG. 20 comprises an end view looking in the direction of travel of the cans along conveyor 184. Vacuum cover applicator 40 utilizes planetary gears 264, 266, 268 which rotate about a center axis 272. The planetary gears engage rods 262, which are secured in plate 254 in a circular fashion as illustrated in FIG. 20. The entire unit rotates in a counter clockwise direction, as viewed in FIG. 20, such that planetary gears 264, 266, 268 rotate in a clockwise direction. Planetary gears 264, 266, 268 are attached to shafts 274 which also rotate in a clockwise direction following a counter clockwise path 278. A plurality of suction devices 276 are attached to shafts 274 and also rotate simultaneously with shafts 274. Cover magazine 280 is mounted on plate 254 and functions to hold a plurality of covers 282 for application to can groups.

In operation, the planetary system of vacuum cover applicator 40 rotates to a position such that vacuum cups 276 align with covers 282 disposed in magazine 280 and a vacuum is applied to suction devices 276 to withdraw a single cover from the stack of covers 282 in cover magazine 280. The planetary system continues to rotate until it is disposed over the cans, at which point, suction is released from suction devices 276 and the cover is disposed in place, as illustrated by cover 286 of FIG. 20.

Figure 21:
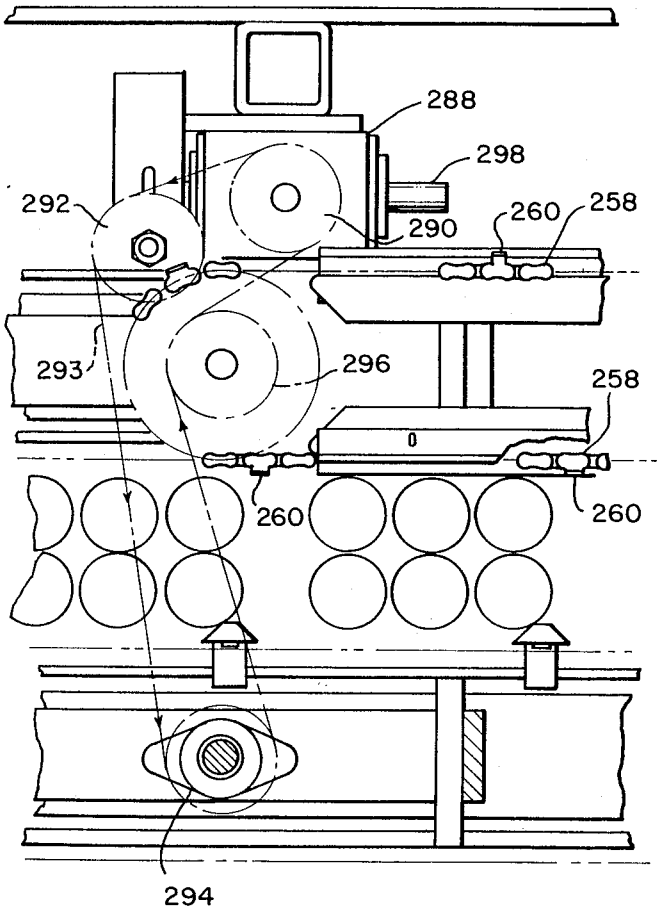

FIG. 21 is a plan view of the downstream end of cover guide chain 258. Chain 258 is driven by gear box 288 which receives power from shaft 298 to drive a drive sprocket 290. Idler sprocket 292 guides the drive chain 293 around end sprockets 294, 296 which drive the cover guide chains 258 disposed on both sides of the row of cans.

Figure 22:
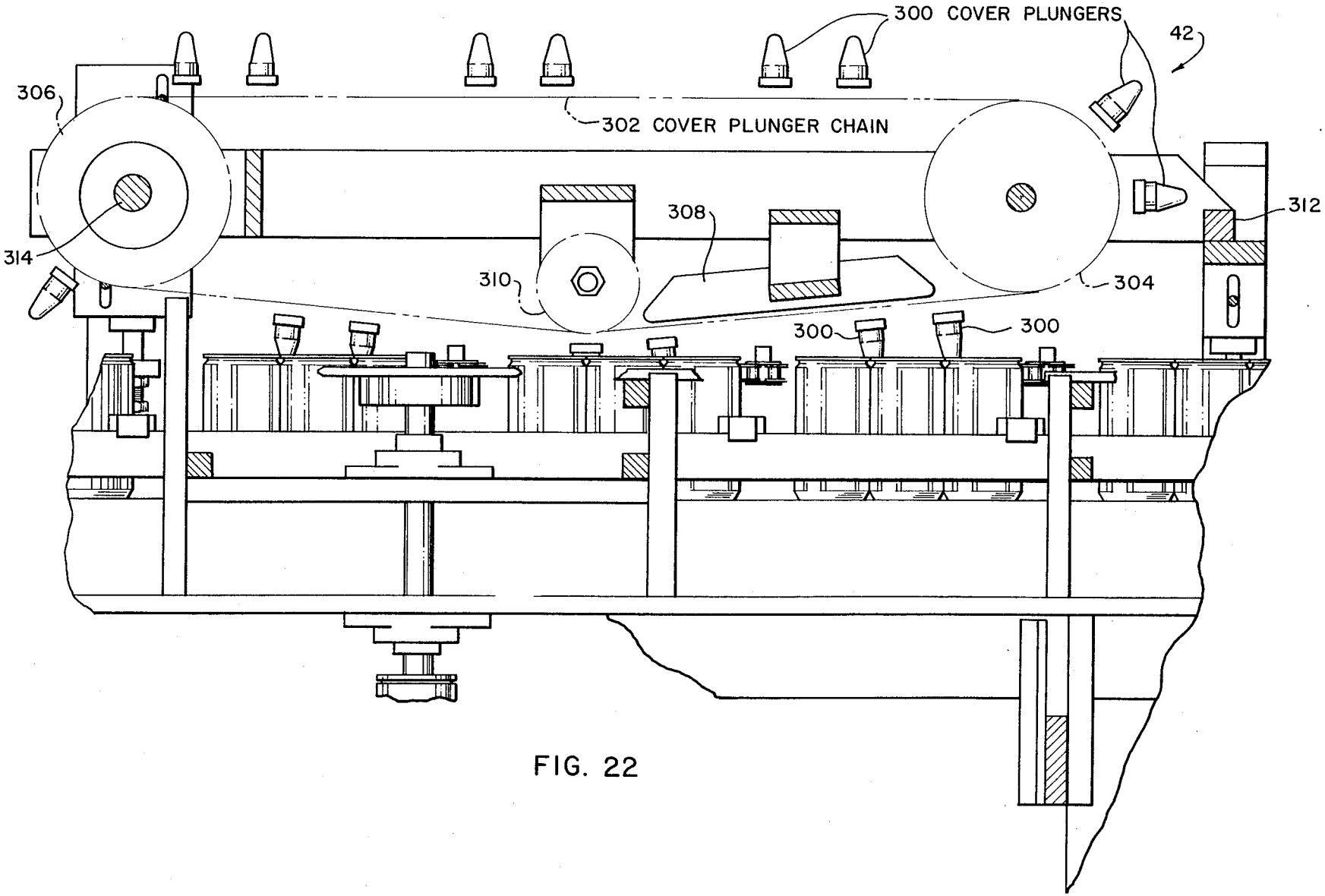

FIG. 22 is an elevation view of the cover seating apparatus 42 which is disposed just downstream of the vacuum cover applicator 40 illustrated in FIG. 19. Cover seating apparatus 42 has a plurality of cover plungers 300 mounted on cover plunger chain 302. The cover plunger chain 302 is synchronized with the movement of cans so that cover plungers 300 are guided by guide 308 to penetrate the cover at the center location 430 of portions 406, 408, as shown in Fig. 15, which is aligned with finger hole openings of the clip holding the group of cans together. The cover 400 has been previously cut at 410–418 so that as cover plungers 300 are fully inserted in the finger holes directly below idler wheel 310, portions 406, 408 are pushed into the finger hole openings causing the cover to seat and lock in position. As the cans and cover plungers 300 proceed synchronously down the conveyor, cover plungers 300 are slowly withdrawn and form an enclosed loop around sprockets 304, 306. If there is a jam in the system, the entire plunger mechanism can be lifted at 312 and pivoted around axis 314 of sprocket 306 so that the entire mechanism can be pivoted out of the way and jams removed.

Figure 23:
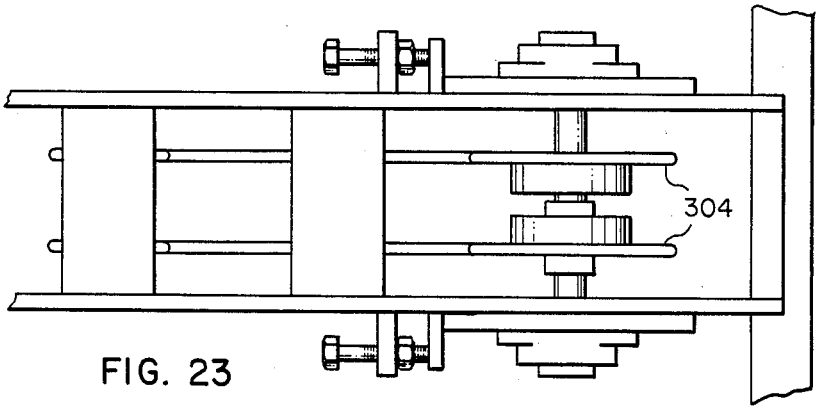
Figure 24:
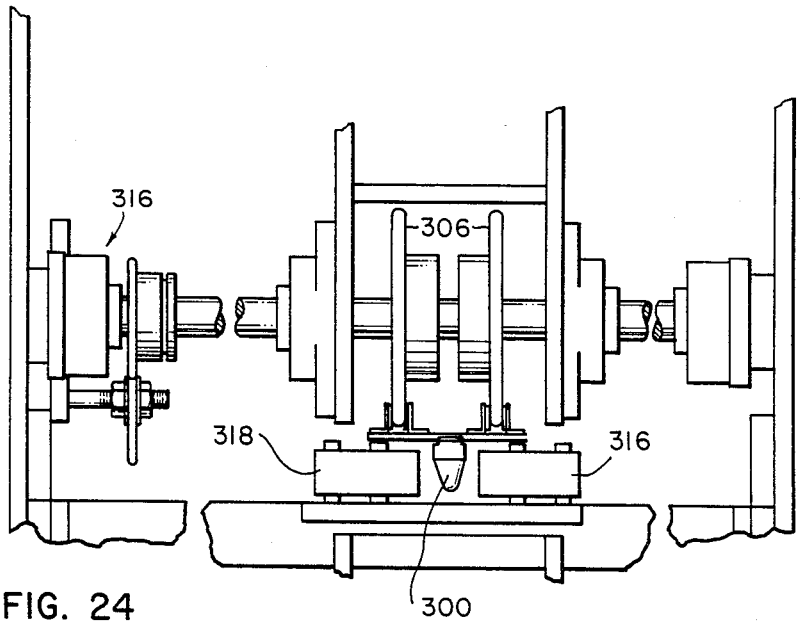

FIGS. 23 and 24 illustrate a schematic plan view of the cover seating apparatus 42 illustrated in FIG. 22. FIG. 23 illustrates sprocket 304 while FIG. 24 illustrates sprocket 306 and plunger 300. Additionally, the drive mechanism 316 of sprocket 306, as well as glue guns 316,318 are also illustrated in FIG. 24.

Following the cover seating apparatus 42 illustrated in FIGS. 22 through 24, there is a break point in the machine so that the remaining portion of the machine can be removed when covers are applied which do not have skirted portions 402, 404. For example, it may be desired to apply a removable coupon to the top portion of the cans which can be secured by the locking mechanism of the finger hole when fully seated by the cover seating apparatus 42. In this case, the coupon would not have skirted portions 402, 404 and, consequently, not require any further apparatus such as illustrated in FIGS. 25–29.

Figure 25:
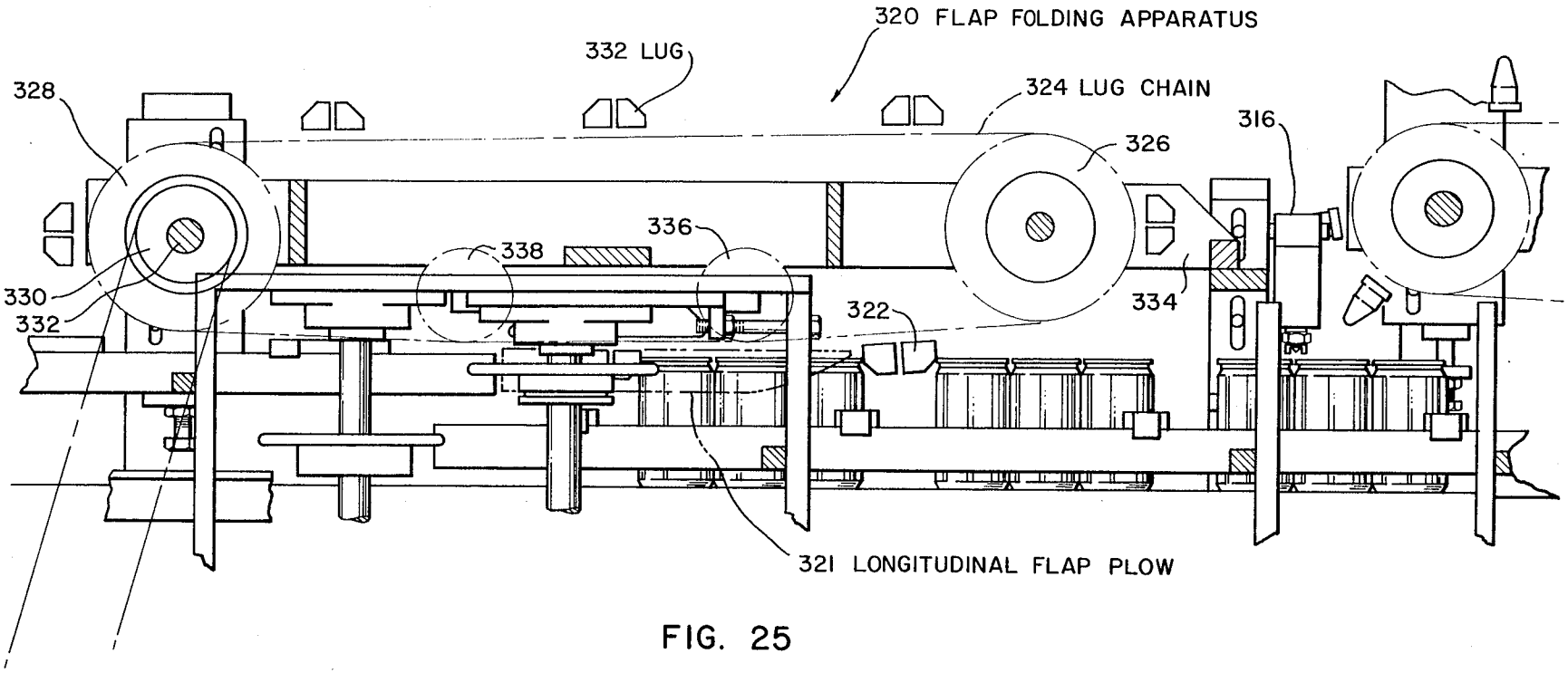

FIGS. 25 through 29 disclose the cover gluing and folding apparatus 44. FIG. 25 is an elevation view of the flap folding device 320. Glue guns 316, 318 are disposed between the cover seating apparatus 42 and flap folding apparatus 320 and are more clearly illustrated in FIG. 24. The two glue guns apply glue to the short flaps prior to folding. Flap folding apparatus 320 has a plurality of lugs 322 attached to lug chain 324 which passes around sprockets 326 and 328. Lug chain 324 is driven synchronously with the movement of the cans by drive sprocket 330. Lugs 322 fit in the openings between can groups and are synchronized to align with these openings. Guides sprockets 336, 338 cause the lugs 322 to be inserted between can groups and fold the short flaps along the end portions of the can groups. The flap folding apparatus 320 is pivoted at sprocket 332 such that the entire apparatus can be lifted if jamming occurs in the flap folding apparatus 320. FIG. 25 also illustrates the longitudinal flap plow 321 which has a double curved surface for folding the longitudinal flaps 404. Longitudinal flap plows are disposed on both sides of the row of cans for folding longitudinal flaps around both sides of the cans simultaneously.

Figure 26:
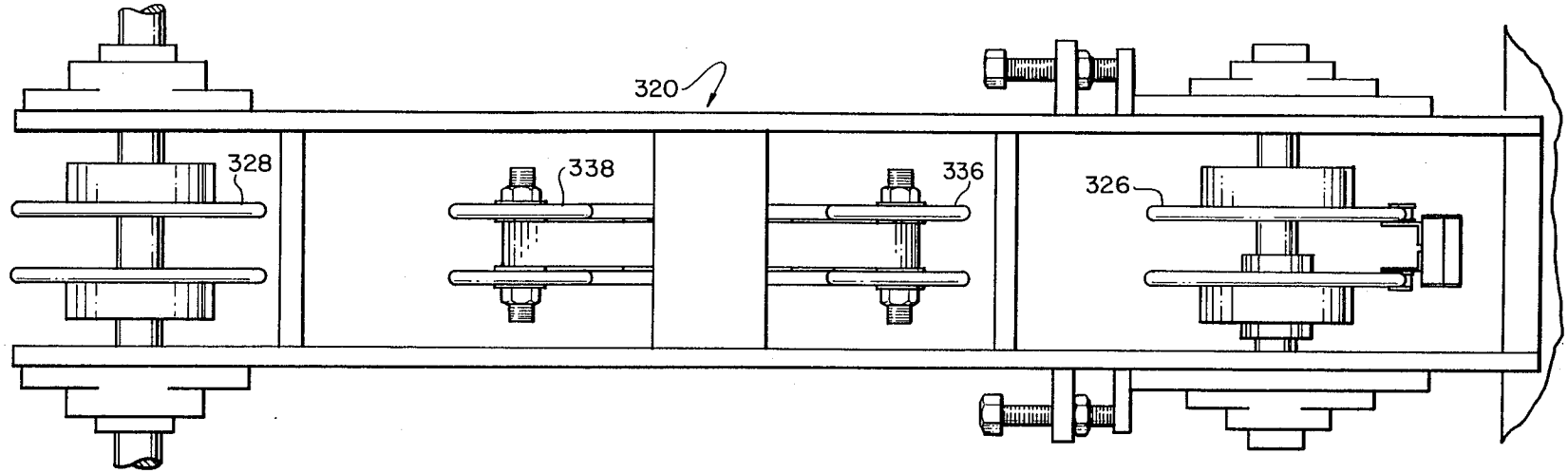

FIG. 26 is a plan view of the short flap folding apparatus 320 illustrating sprockets 326, 328, 336, and 338.

Figure 29:
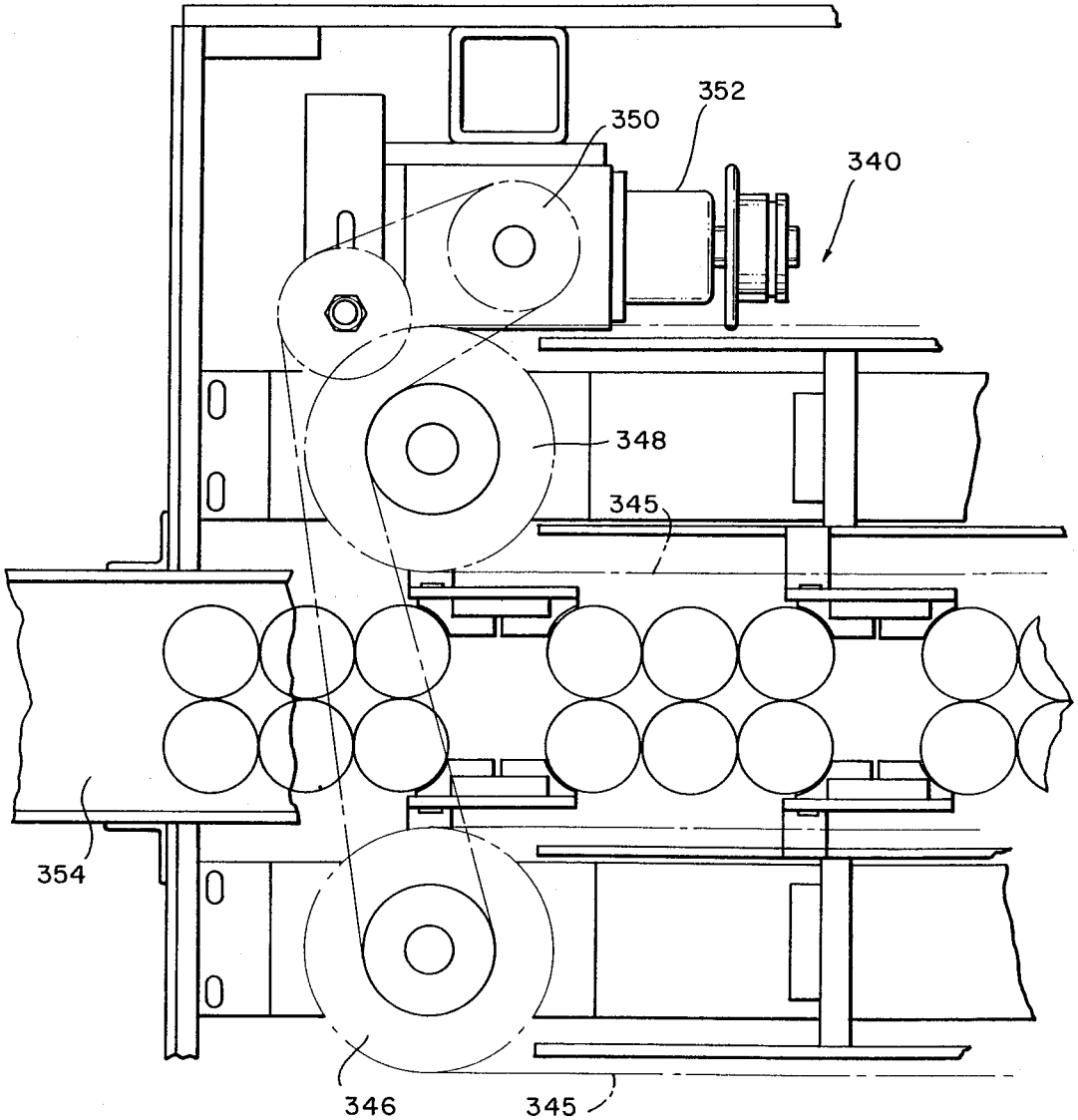
Figure 27:
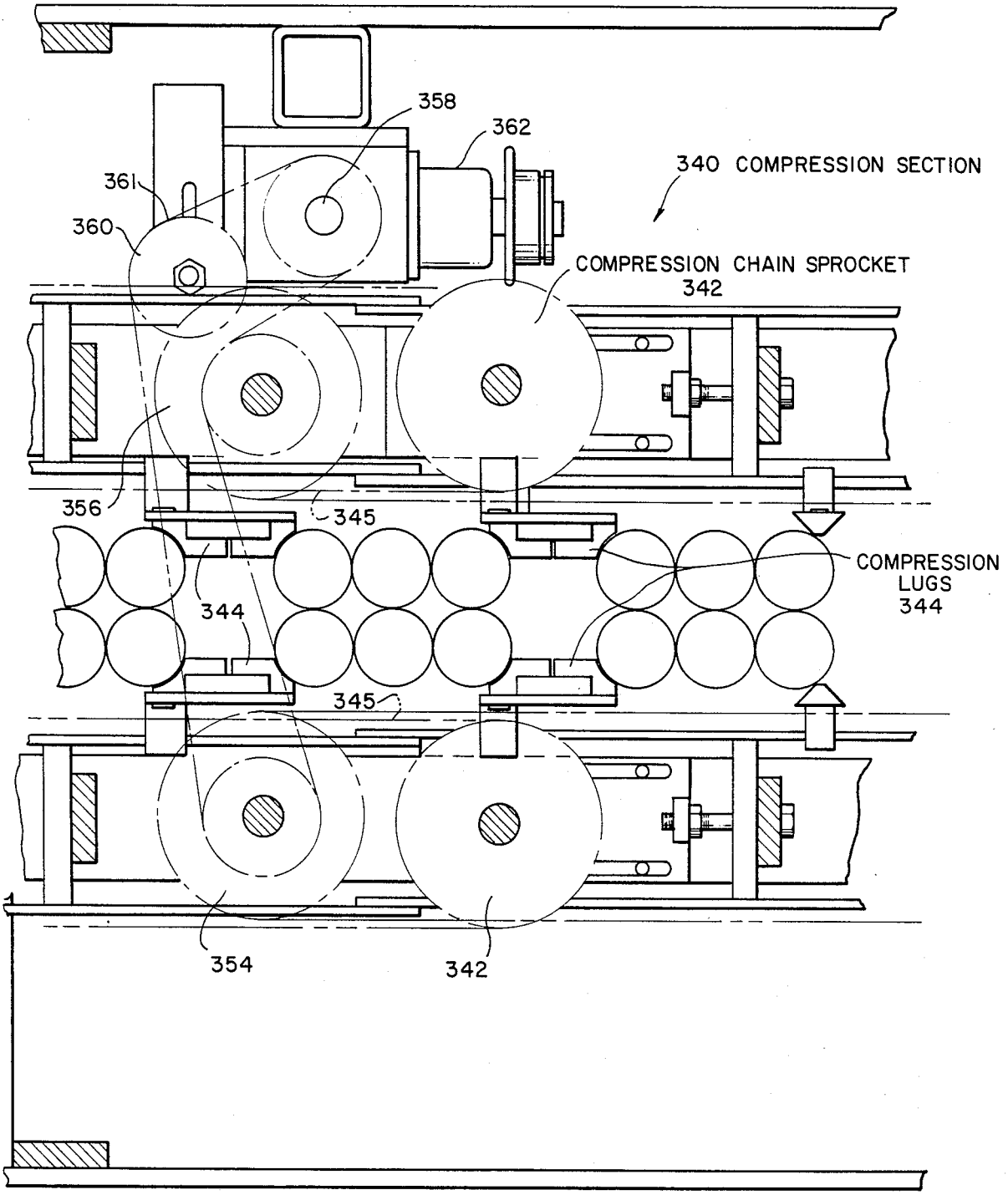
Figure 28:
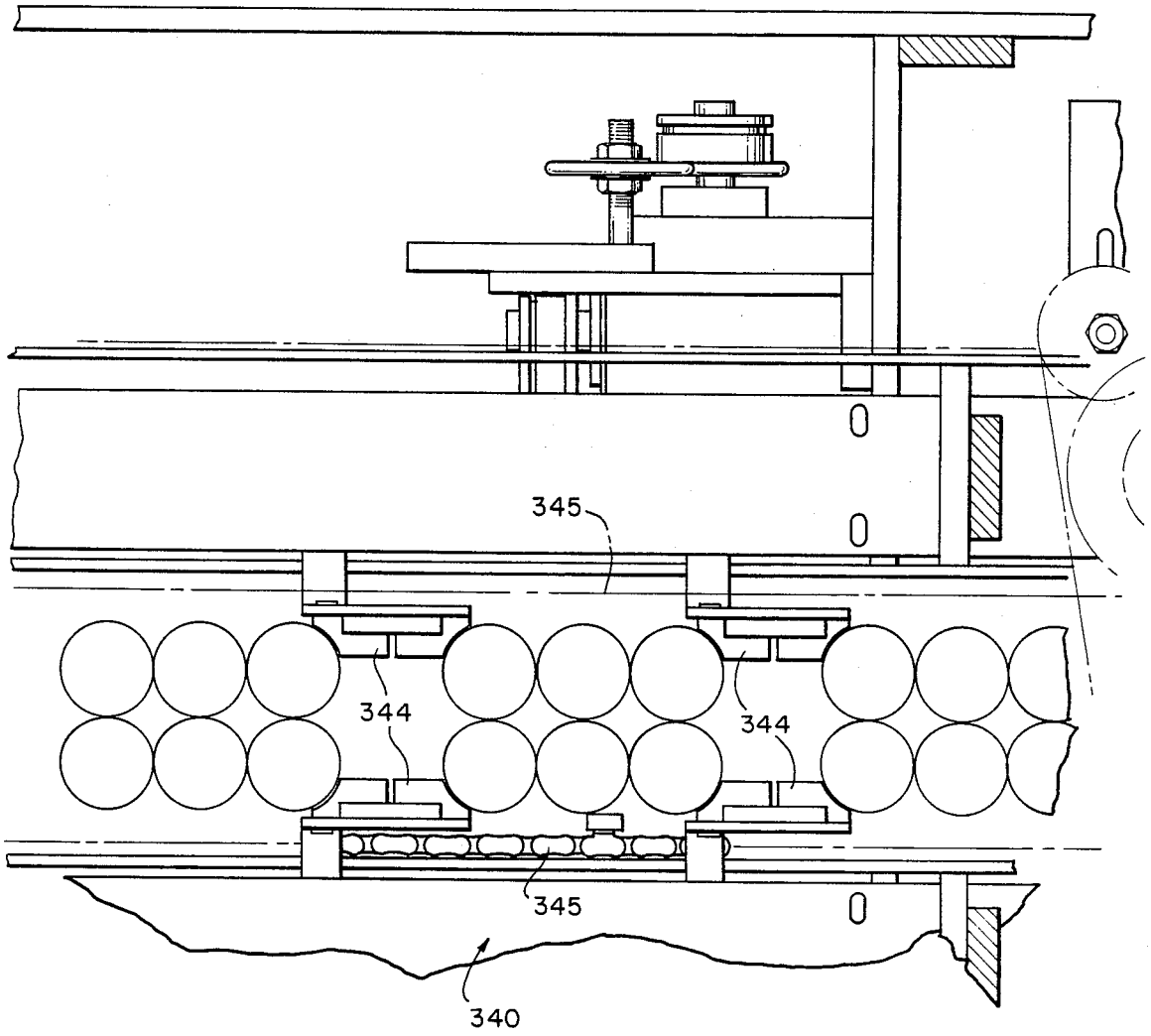

FIGS. 27 through 29 are a plan view of the compression section 340 of the cover gluing folding apparatus 44. As illustrated in FIG. 27, compression lugs 344 are mounted on a compression lug chain 345 which is guided by compression chain sprockets 342. Compression lugs 344 have forming pockets which conform to the can body and act as a compression section for allowing the hot glue dispensed by glue guns 316, 318 to set up. The compression section, as illustrated in FIGS. 27, 28, and 29, is approximately 2 feet long to allow sufficient time for the hot melt glue to adhere to the flaps 402, 404 which have been folded around the sides of the can. The compression lug chain 345 is driven by drive sprockets 346, 348, and 350 which receive power from gear box 352. Compression lugs 344 release the cans after they pass drive sprockets 346, 348 and the cans proceed to a packing station on conveyor 354. Drive sprockets 354, 356 are driven by drive sprocket 358 by drive train 361 which is guided by idler sprocket 360. Drive sprocket 358 receives power from gear box 362. These sprockets function as drive sprockets for lug chains 246 and 248.

The foregoing description of the invention has been presented for the purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. The method of applying connecting clips, each of the clips comprising a central portion having an opening formed therein and a plurality of ear portions extending outwardly in a radial direction from the central portion with the ear portion being spaced ninety degrees apart so as to have a longitudinal center line between pairs of ear portions spaced one hundred and eighty degrees apart, to groups of unattached containers to form multiple container packages of at least four containers, comprising the steps of:

continuously forming a plurality of parallel rows of said containers;

conveying said plurality of parallel rows of said unattached containers to a clip applicator;

separating said unattached containers by a predetermined distance to define central gaps between adjacent unattached containers suitable for applying said connecting clips by transversely separating said unattached containers by a predetermined distance using a plate divider; and longitudinally separating said unattached containers by a predetermined distance using side lugs which couple directly to sidewalls of said containers;

feeding a plurality of clips to a first separating and orienting means;

separating said clips one from another;

feeding said separated clips to a first track for movement over said track and orienting said clips so that the longitudinal center lines of each clip form an x in relation to the direction of movement of said clips over said first track;

moving said clips to a second orienting means;

rotating said clips through forty-five degrees in said second orienting means;

feeding said rotated clips to a second track and moving said clips over said second track so that the longitudinal center lines of each clip form a + in relation to the direction of movement of said clips over said second track;

positioning said connecting clips for application to said central gaps between said unattached containers using a clip applicator wheel;

applying said connecting clips to said groups of unattached containers by forcing said connecting clips into said central gaps using a cam actuated clip applicator.

2. A method as in claim 1 and further comprising:

placing covers in proximate relationship with said multiple container packages;

attaching said covers to said multiple container packages; and gluing and folding flap portions of said covers around said multiple container packages.

3. A method as in claim 1 and further comprising:

locating said first and second tracks so that they extend relative to each other at an angle of ninety degrees;

connecting said first and second tracks by a turn section; and rotating said clips through said forty-five degree angle in said turn section.

4. A method as in claim 3 and further comprising:

restraining the movement of one of said ear portions of each clip in said turn section so that said clip pivots on said ear portion through said forty-five degrees.

5. A method as in claim 4 and further comprising:

applying a force to each of said clips to ensure rotation of said clips and movement of said clips into said second track.

6. Apparatus for applying clips to groups of unattached containers to form multiple container packages of at least four containers held in substantially parallel closely spaced arrangement by mounting said clips in a central gap formed between said groups of unattached containers and engaging rim portions of said unattached containers to form said multiple container packages comprising:

container infeed conveyor means for laterally moving a plurality of parallel rows of said unattached containers in a closely spaced, generally abutting relationship;

container separating means associated with said container infeed conveyor means for longitudinally and transversely separating said unattached containers by a predetermined distance so as to define central gaps suitable for mounting said clips;

each of said clips comprising a central portion having an opening formed therein and a plurality of ear portions extending outwardly in a radial direction from said central portion;

said ear portions being spaced ninety degrees apart so as to have a longitudinal center line between pairs of ear portions spaced one hundred and eighty degrees apart;

means for feeding a plurality of clips to a first separating and orienting means;

said first separating and orienting means having means for separating said clips one from another and for feeding said clips to a first track for movement over said first track with the longitudinal center lines between opposite pairs of said ear portions forming an x in relation to the direction of movement of said clips over said first track;

second orienting means for receiving said clips from said first track, rotating said clips through forty-five degrees and feeding said clips to a second track for movement over said second track with the longitudinal center lines between opposite pairs of ear portions in the form of a + in relation to the direction of movement of said clip over said second track;

a clip pick up station for receiving clips from said second track; and clip applicator means for removing said clip from said clip pick up station and applying said clips to said groups of unattached containers to form said multiple container packages.

7. The apparatus of claim 6 wherein said container separating means comprises:

transverse separating means for providing a predetermined transverse space between said two parallel rows of said unattached containers;

longitudinal separating means for providing a predetermined longitudinal space between cans in each row of said two parallel rows of said unattached containers;

said longitudinal separating means comprising side lug chain means coupled to side lug means for engaging peripheral portions of said unattached containers and holding said unattached containers with said predetermined lateral space during application of said clips;

said side lug means comprising a plurality of equally spaced shoe members attached to said side lug chain means; and each of said shoe members having a plurality of arcuate surfaces for contacting the trailing side of one can and the leading side of the next can.

8. The apparatus of claim 1 further comprising:

container package conveyor means for receiving said multiple container packages from said clip applicator means and separating said multiple container packages from one another and maintaining a uniform spacing between adjacent multiple container packages while moving said multiple container packages from said clip applicator means.

9. The apparatus of claim 1 further comprising:

cover applicator means for receiving said multiple container packages from said container package conveyor means and applying a cover member to each of said multiple container packages.

10. The apparatus of claim 6 and further comprising:

moving conveyor means for moving clips from an exit of said second orienting means to said clip pick station;

means for retaining each of said clips at said clip pick up station;

clip holding means for removing said clips from said clip pick up station;

rotary wheel means mounted for rotation about a horizontal axis extending in a direction perpendicular to the direction of movement of said containers for holding said clip holding means and aligning said clips with said groups of unattached cans in a position suitable for application to said containers;

cam actuated piston means associated with said rotary wheel means for extending said clip holding means to remove said clips from said clip pick up station and to move said clips over a clip guiding means to a position over a central gap between each of said groups of unattached containers;

additional cam means to actuate said piston means to force said clips into retaining association with said groups of unattached containers;

means for separating said clip holding means from said clips.

11. The apparatus of claim 9 wherein said cover applicator means comprises:

cover magazine means for holding a plurality of said covers;

vacuum cover applicator means for placing covers in proximate relationship with said multiple container packages;

said vacuum cover means comprising:

planetary means for rotating a plurality of shafts in a predetermined rotational direction following a rotational path having a rotational direction opposite to said predetermined rotational direction;

suction means attached to said shafts for removing covers separately from said cover magazine means and placing said covers in proximate relationship with said multiple container packages as a result of movement of said shafts;

cover seating means for attaching said covers to said multiple container packages;

cover plunger means for insertion through said covers into finger openings of said clips to attach said covers to said multiple container packages;

means for synchronously advancing said cover plunger means with said multiple container packages;

means for inserting said cover plunger means in said finger openings while said cover plunger means are synchronously advanced with said multiple container packages;

cover gluing and folding means for gluing and folding peripheral portions of said covers around said multiple container package;

said gluing means comprising:

glue gun means for applying glue to short flap portions of said covers;

said cover folding means comprising:

lug means for insertion in spaces between said multiple container packages for folding said short flap portions of said covers over said end portions of said multiple container packages;

means for synchronously advancing said lug means with said multiple container packages;

means for inserting said lug means in said spaces between said multiple container packages while said lug means are synchronously advancing with said multiple container package;

said cover gluing means comprising:

longitudinal flap folding means for folding longitudinal flap portions of said covers over side portions of said multiple container packages;

compression means for holding said short flap portions and said longitudinal flap portions together for a predetermined period sufficient to allow glue applied to said covers to join said short flap portions and said longitudinal flap portions.

12. The apparatus of claim 11 wherein:

said means for synchronously advancing said cover plunger means comprises a synchronously driven plunger chain and synchronously driven plunger chain sprockets; and said means for synchronously advancing said lug means comprises a synchronously driven lug chain and synchronously driven lug chain sprockets.

13. The apparatus of claim 12 and further comprising:

means for pivoting said cover seating means to a position to allow access to said multiple container packages.

14. The apparatus of claim 13 wherein said compression means comprises:

compression lug means having compression pockets formed therein which are adapted to conform to container body members of said multiple container packages to hold flap portions of said covers while said glue adheres to said flaps;

means for synchronously advancing said compression lug means with said multiple container packages and aligning said compression pockets to hold said flap portions of said covers against said can body members.

15. The apparatus of claim 6 and further comprising:

said first and second tracks being located relative to each other at an angle of ninety degrees;

a turn section connecting said first and second tracks; and said means for rotating said clips through forty-five degrees being located in said turn section.

16. The apparatus of claim 15 wherein said means for rotating said clips through forty-five degrees comprises:

means for restraining the movement of one ear portion of said clip through said turn section so that said clip pivots on said one ear portion through said forty-five degrees.

17. The apparatus of claim 16 and further comprising:

means for applying a force to said clips to ensure said rotation of said clips and movement of said clips into said second track.

18. The apparatus of claim 17 wherein:

said means for applying a force comprises an air jet.

* * * * *